US005113222A

United States Patent [19]

Wilson et al.

[11] Patent Number: 5,113,222

[45] Date of Patent: May 12, 1992

[54] REPRODUCTION APPARATUS WITH IMPROVED DISPLAY FOR USE IN JOB SET-UP

[75] Inventors: James Wilson, Rochester; LinMarie Stephenson, Brockport; Kenneth G. Corl, Brighton, all of N.Y.

[73] Assignee: Eastman Kodak Company, Rochester, N.Y.

[21] Appl. No.: 643,878

[22] Filed: Jan. 22, 1991

[51] Int. Cl.[5] ..... G03G 21/00

[52] U.S. Cl. ..... 355/209; 355/313; 364/146; 364/188; 340/712

[58] Field of Search ..... 355/204, 209, 206, 313; 364/146, 188; 340/712, 715

[56] References Cited

U.S. PATENT DOCUMENTS

Re. 32,253 9/1986 Bartulis et al. .
4,970,549 11/1990 Yoshizuka et al. ..... 355/209
5,012,280 4/1991 Tsutsumi et al. ..... 355/206

*Primary Examiner*—R. L. Moses
*Assistant Examiner*—Patrick J. Stanzione
*Attorney, Agent, or Firm*—Norman Rushefsky

[57] ABSTRACT

In an electrostatographic reproduction apparatus there is provided an operator control panel having a display screen indicating certain standard selectable features for a copying operation including copy format (simplex to duplex, etc.), paper supply source, copy quality, magnification and exit location with plural displayed options for each feature. Keys and buttons are provided for altering the display to indicate a displayed selected option for each. For more complex operations the display may be changed to display various operator selectable special job level features for a copying operation available on a job level basis. The displaying is further alterable to display various operator selectable special page level features for a copying operation specific to reproducing a selected page of a multisheet document job. Thus a layered approach is provided in the series of displays from a standard features presentation which a casual user would be comfortable using, to a job level features presentation for a more complex reproduction at the job level, to a page level features presentation for designation of specific page level features for selection. User friendliness is enhanced with consistent use of indicia identifying a feature under consideration, selection of such feature and whether or not additional screens must be called up to further define that feature and further identifying other features which may not be chosen when a certain feature is chosen.

27 Claims, 49 Drawing Sheets

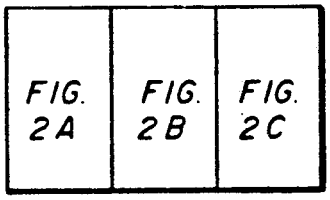

FIG. 2

CONTROL PANEL AND FUNCTIONS

OCP

COPIES IN PROCESS-THE NUMBER OF COPIES OR SETS THAT HAVE BEEN COMPLETED AT ANY MOMENT WILL BE SHOWN AT THE TOP OF THIS DISPLAY AREA.

COPIES REQUESTED
THE NUMBER OF COPIES OR SETS REQUESTED WILL BE SHOWN AT THE BOTTOM OF THE DISPLAY AREA. UP TO 9999 COPIES OR SETS CAN BE REQUESTED.

CND

NUMERIC BUTTONS
PRESS THESE BUTTONS TO SET THE NUMBER OF COPIES OR SETS TO BE MADE. PRESS "C" TO REMOVE THIS REQUEST. THE "*" IS USED FOR SPECIAL OPERATIONS.

M (MEMORY)
PRESS TO SAVE THE CURRENT JOB IN MEMORY. UP TO 60 JOBS CAN BE PREPROGRAMMED.

MR (RECALL)
PRESS TO RECALL A JOB. UP TO 60 JOBS CAN BE PREPROGRAMMED.

// (RESET)
PRESS WHEN THE DUPLICATOR IS NOT RUNNING TO RESET ALL THE CONTROLS TO THE STANDARD SETUP.

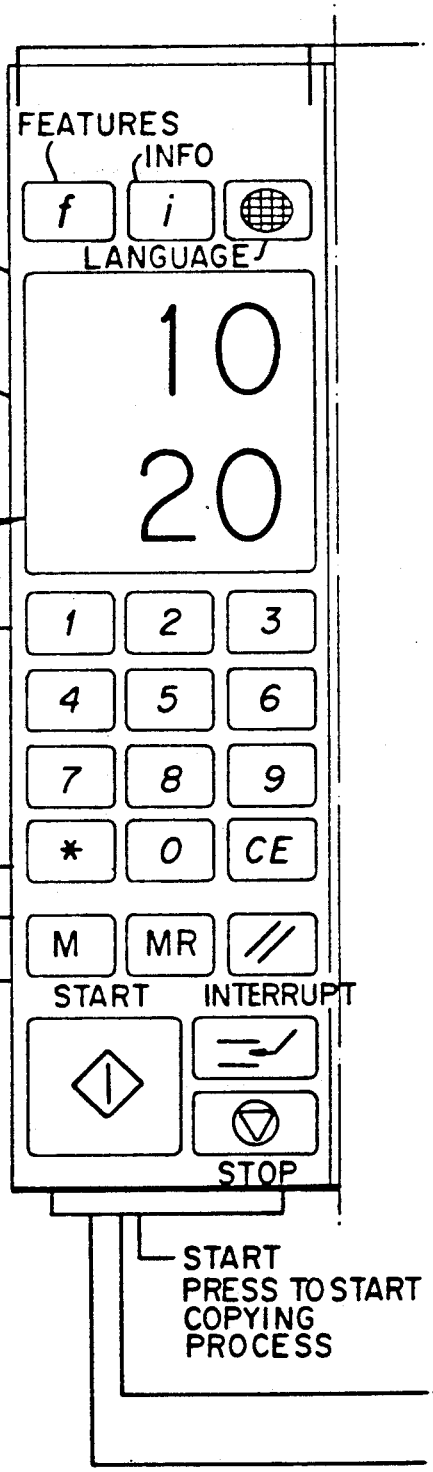

START
PRESS TO START COPYING PROCESS

FIG. 2A

STOP
PRESS THIS BUTTON TO
STOP THE DUPLICATOR AT THAT POINT

INTERRUPT
PRESS TO STOP A JOB IN PROCESS TO RUN
A SECOND JOB. WHEN THE SECOND JOB
HAS BEEN COMPLETED, THE DUPLICATOR
WILL RECOVER TO THE PREVIOUS SETUP.

SPECIAL FEATURES-JOB LEVEL allows you to use the features listed below. All the selections made in this mode will be applied to the entire job.
FIG.6a
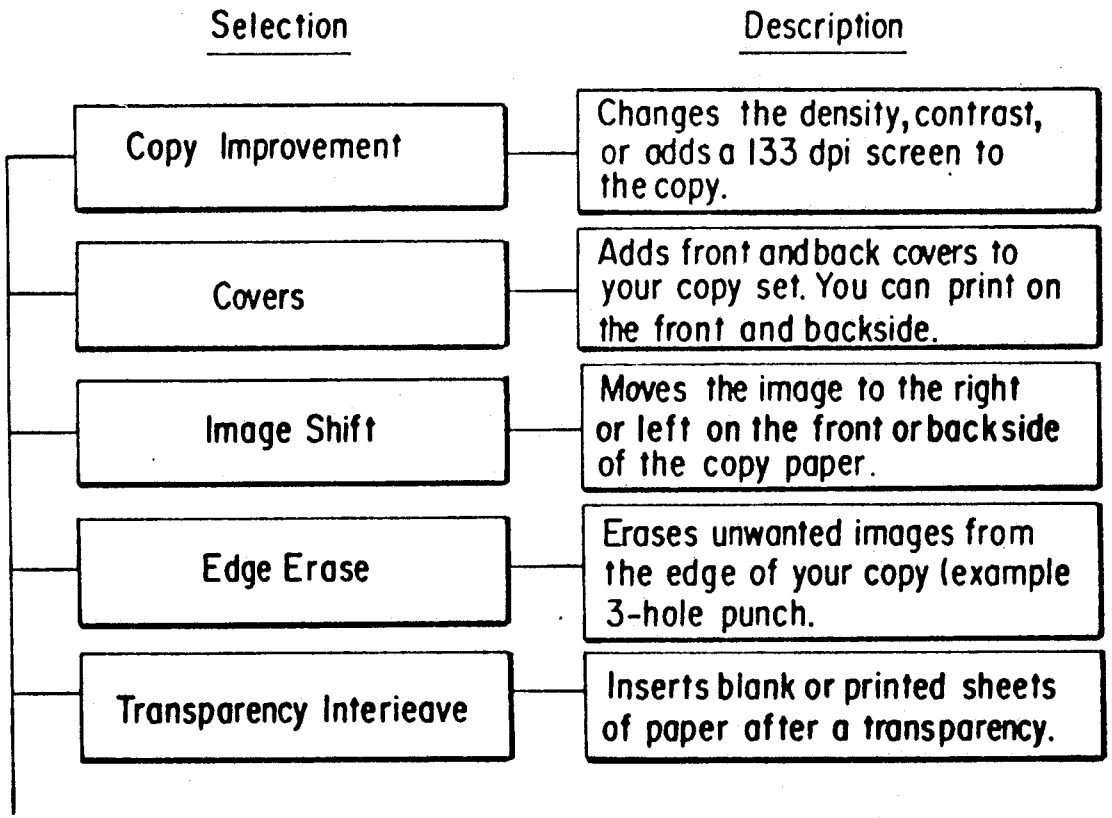
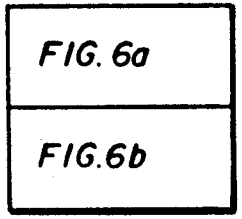
FIG.6

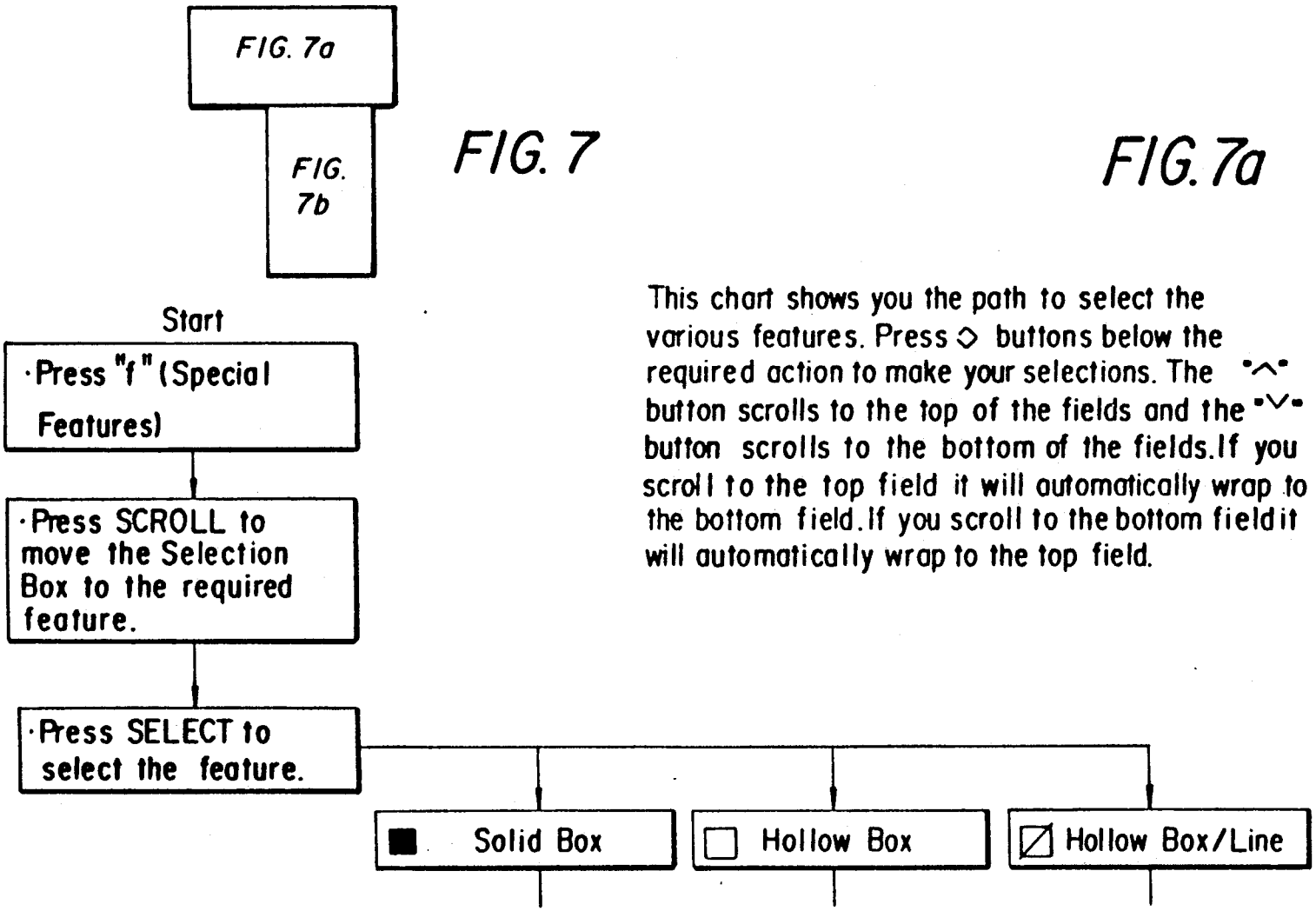

FIG. 7

FIG. 7a

This chart shows you the path to select the various features. Press ◇ buttons below the required action to make your selections. The "^" button scrolls to the top of the fields and the "v" button scrolls to the bottom of the fields. If you scroll to the top field it will automatically wrap to the bottom field. If you scroll to the bottom field it will automatically wrap to the top field.

COPY IMPROVEMENT

THIS FEATURE CHANGES THE DENSITY, CONTRAST, OR ADDS A 133 DOTS-PER-INCH (DPI) SCREEN TO THE COPY. USING THIS FEATURE, YOU CAN IMPROVE THE CLARITY AND RESOLUTION OF YOUR COPY PAGES.

1. PRESS THE "f" BUTTON FOR THE SPECIAL FEATURES SCREEN.

2. Press "SCROLL" to move selection box through features until Copy Improvement is in the box.

3. PRESS "SELECT" TO CHOOSE COPY IMPROVEMENT. A SMALL HOLLOW BOX APPEARS TO SHOW YOU WHICH FEATURE YOU HAVE SELECTED.

4. PRESS "DONE/EXIT" FOR NEXT SCREEN.

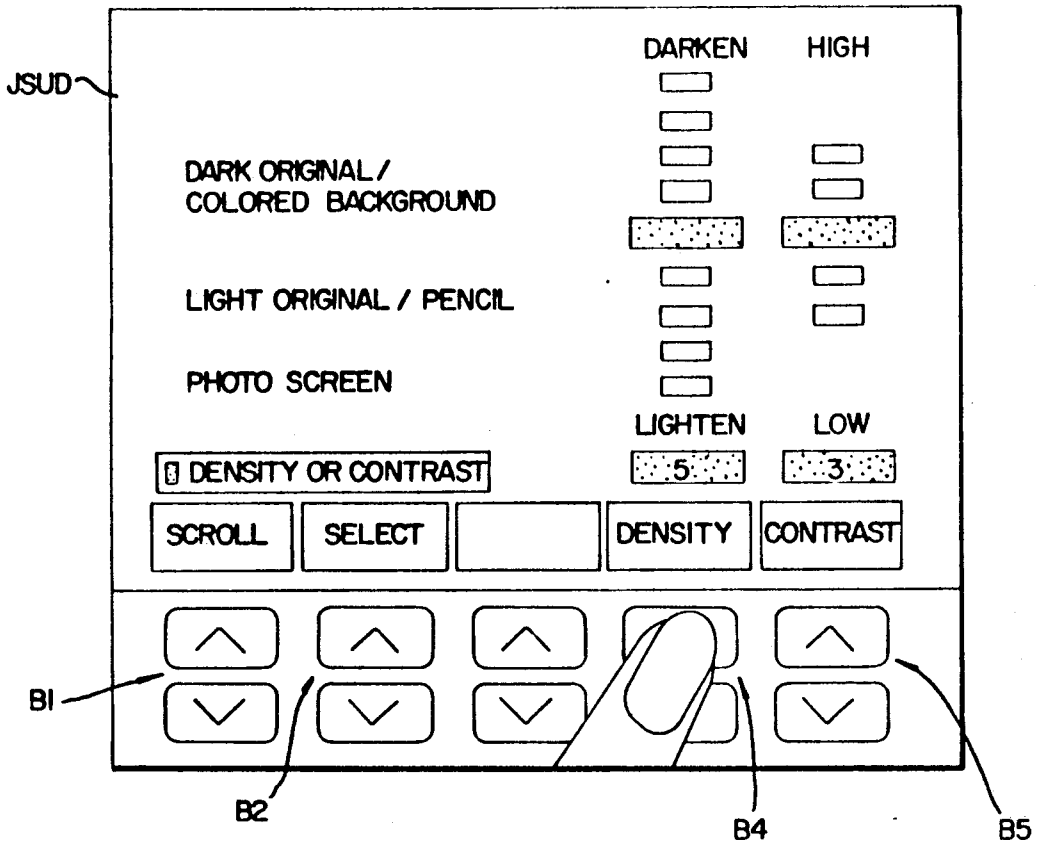

YOU CAN CHOOSE ANY OF THE FOLLOWING OPTIONS:

- DENSITY OR CONTRAST - MODIFIES THE TONE RANGE ON COPIES MADE FROM PHOTOGRAPHS, PHOTOS WITH TEXT AND ORIGINALS CONTAINING BOTH LIGHT AND DARK IMAGES.
- PHOTO SCREEN - IMPROVES THE CLARITY AND RESOLUTION OF COPIES MADE FROM ORIGINALS CONTAINING PHOTOGRAPHS.
- LIGHT ORIGINAL / PENCIL - IMPROVES THE COPY QUALITY WHEN ORIGINALS ARE LIGHTER THAN NORMAL.
- DARK ORIGINAL / COLORED BACKGROUND - IMPROVES COPY QUALITY WHEN ORIGINALS ARE DARK OR HAVE A DARK BACKGROUND. FOR EXAMPLE, ORIGINALS ON COLORED PAPER STOCK.

NOTE: SOLID SELECTION BOX ON DENSITY OR CONTRAST IS THE DEFAULT ON THIS SCREEN.

1. PRESS "SCROLL" THEN "SELECT" TO CHOOSE ANOTHER OPTION.
2. ADJUST "DENSITY" OR "CONTRAST", IF NECESSARY.

FIG.8(e)

3. PRESS "DONE /EXIT" WHEN FINISHED.

NOTE: YOU ARE NOW BACK AT THE SPECIAL FEATURES SCREEN. NOTICE THE SELECTION BOX IS NOW A SOLID.

1. PRESS "SCROLL" THEN "SELECT" TO CHOOSE ANOTHER FEATURE IF NECESSARY.
2. PRESS "DONE/EXIT" WHEN FINISHED TO BRING YOU BACK TO THE STANDARD FEATURES SCREEN.

3. PRESS "START" TO BEGIN COPYING.

COPY IMPROVEMENT

THIS FEATURE CHANGES THE DENSITY, CONTRAST, OR ADDS A 133 DOTS-PER-INCH (DPI) SCREEN TO THE COPY.

- PLACE ORIGINALS IN FEEDER/POSITIONER.
- PRESS "START" UNTIL REQUIRED ORIGINAL IS ON TOP.
- PRESS THE "f" BUTTON FOR THE SPECIAL FEATURES SCREEN.

· PRESS "PAGE LEVEL" TO SELECT PAGE LEVEL SPECIAL FEATURES.

· PRESS "SCROLL" TO MOVE SELECTION BOX THROUGH FEATURES UNTIL COPY IMPROVEMENT IS IN THE BOX.

· PRESS "SELECT" TO CHOOSE COPY IMPROVEMENT. A SMALL HOLLOW BOX APPEARS TO SHOW YOU WHICH FEATURES YOU HAVE SELECTED.

· PRESS "DONE/EXIT" FOR NEXT SCREEN.

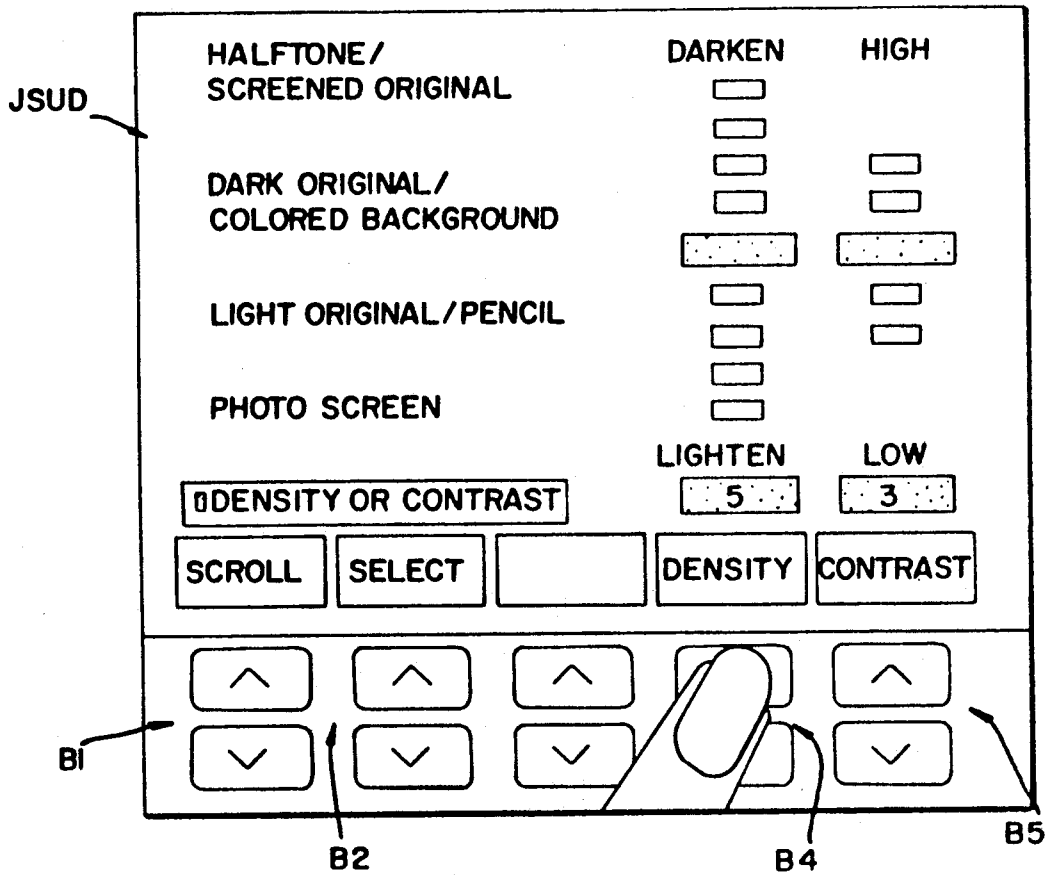

NOTE: SOLID SELECTION BOX ON DENSITY OR CONTRAST IS THE DEFAULT ON THIS SCREEN.

- DENSITY OR CONTRAST MODIFIES THE TONE RANGE ON COPIES MADE FROM PHOTOGRAPHS, PHOTOS WITH TEXT AND ORIGINALS CONTAINING BOTH LIGHT AND DARK IMAGES.
- PHOTO SCREEN
- LIGHT ORIGINAL/PENCIL
- DARK ORIGINAL/COLORED BACKGROUND
- HALFTONE/SCREENED ORIGINAL
- PRESS "SCROLL" THEN "SELECT" TO CHOOSE ANOTHER OPTION.
- ADJUST "DENSITY" OR "CONTRAST", IF NECESSARY.

FIG. 9(f)

· PRESS "DONE/EXIT" WHEN FINISHED.

NOTE: YOU ARE NOW BACK AT THE SPECIAL FEATURES-PAGE LEVEL SCREEN. NOTICE THE SELECTION BOX IS NOW SOLID.

· PRESS "SCROLL" THEN "SELECT" TO CHOOSE ANOTHER FEATURE IF NECESSARY.

- PRESS "ARRANGE STACK" TO PUT ORIGINALS IN ORDER, "JOB LEVEL" WHEN FINISHED.
- PRESS "DONE / EXIT" WHEN FINISHED TO BRING YOU BACK TO THE STANDARD FEATURES SCREEN.
- PRESS "START" TO BEGIN COPYING

| FIG. 10A |
| --- |
| FIG. 10B |

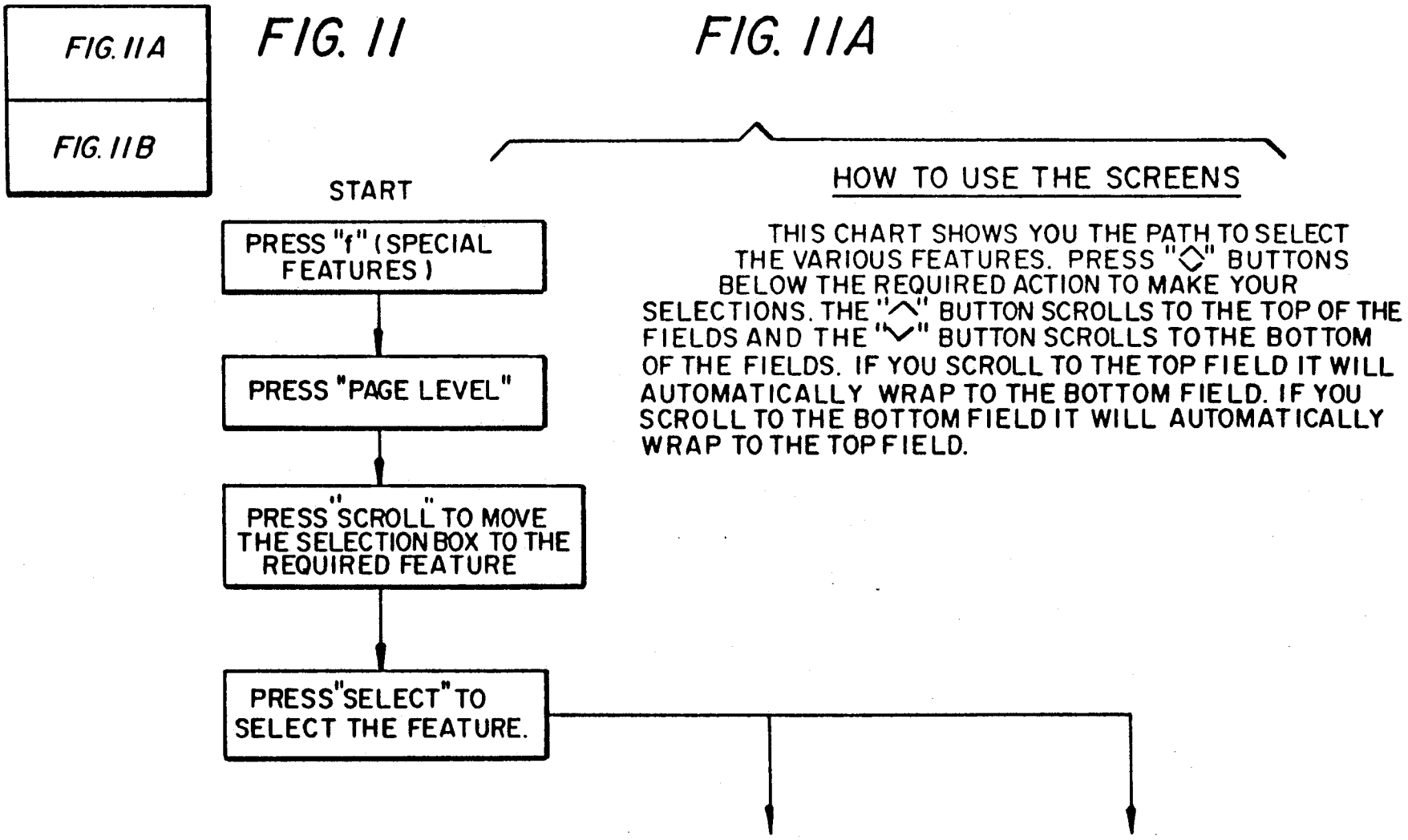
FIG. 11
FIG. 11A
FIG. 11B
START
PRESS "f" (SPECIAL FEATURES)
PRESS "PAGE LEVEL"
PRESS "SCROLL" TO MOVE THE SELECTION BOX TO THE REQUIRED FEATURE
PRESS "SELECT" TO SELECT THE FEATURE.
HOW TO USE THE SCREENS
THIS CHART SHOWS YOU THE PATH TO SELECT THE VARIOUS FEATURES. PRESS "<>" BUTTONS BELOW THE REQUIRED ACTION TO MAKE YOUR SELECTIONS. THE "<" BUTTON SCROLLS TO THE TOP OF THE FIELDS AND THE ">" BUTTON SCROLLS TO THE BOTTOM OF THE FIELDS. IF YOU SCROLL TO THE TOP FIELD IT WILL AUTOMATICALLY WRAP TO THE BOTTOM FIELD. IF YOU SCROLL TO THE BOTTOM FIELD IT WILL AUTOMATICALLY WRAP TO THE TOP FIELD.

SELECTIVE EDIT

THIS FEATURE LETS YOU SELECT AREAS ON THE ORIGINAL TO ADD A SCREEN COLOR, ERASE AN AREA, AND HIGHLIGHT THE BACKGROUND.

- PLACE ORIGINALS IN FEEDER/POSITIONER.
- PRESS "START" UNTIL REQUIRED ORIGINAL IS ON TOP.

- PRESS THE "FEATURE" ("f") BUTTON TO BRING UP THE SPECIAL FEATURES SCREEN.

· PRESS "PAGE LEVEL" TO SELECT PAGE LEVEL SPECIAL FEATURES.

· PRESS "SCROLL" TO MOVE SELECTION BOX THROUGH FEATURES UNTIL SELECTIVE EDIT IS IN THE BOX.

· PRESS "SELECT" TO CHOOSE SELECTIVE EDIT. A SMALL HOLLOW BOX APPEARS TO SHOW YOU WHICH FEATURE YOU HAVE SELECTED.

·PRESS "DONE/EXIT" FOR NEXT SCREEN.

· PRESS "START" TO MAKE INTERMEDIATE COPY.

· PLACE ON SELECTIVE EDIT AREA, FACE UP.

· PRESS "DONE/EXIT" FOR NEXT SCREEN.

·PRESS "SCROLL" THEN "SELECT" USING " ^ v " ON CONTROL PANEL TO PICK FEATURE.

· PICK TWO OPPOSITE CORNERS OF THE AREA YOU WANT TO EDIT ON INTERMEDIATE COPY WITH EDIT PEN.

· TOUCH INSIDE OR OUTSIDE OF AREA TO APPLY THE OPTION.

·OR USE EDIT PEN TO TOUCH NUMBERED "^" ON EDIT LABEL.

NOTE: WHEN ITEM SELECTED, A SMALL SOLID BOX APPEARS TO SHOW YOU WHICH ITEM YOU HAVE SELECTED.

NOTE: THE AREA YOU HAVE SELECTED IS NOW SHADED.

NOTE: YOU CAN PICK UP TO NINE DIFFERENT SELECTIVE EDIT AREAS.

·PRESS "DONE/EXIT" WHEN FINISHED FOR NEXT SCREEN.

·PRESS "DENSITY" OR "CONTRAST" IF NECESSARY.

·PRESS "SCROLL" THEN "SELECT" TO CHOOSE ANOTHER OPTION.

·PRESS "DONE/EXIT" WHEN FINISHED.

·PRESS "START" TO BEGIN COPYING.

REPRODUCTION APPARATUS WITH IMPROVED DISPLAY FOR USE IN JOB SET-UP

BACKGROUND OF THE INVENTION

1. Field of the Invention

The invention relates to reproduction apparatus, such as electrostatographic copier/duplicators, and more particularly to such apparatus and displays used therewith for facilitating operator input of a complete copying operation.

2. Brief Description of the Prior Art

In the prior art reproduction apparatus such as electrostatographic copiers/duplicators are known for producing reproductions of documents. In such apparatus a multisheet document may be reproduced with the option of allowing the operator to select from a multitude of possible copying operations. For example, the reproduction operation may be selected either as a simplex to simplex, simplex to duplex, duplex to duplex or duplex to simplex. Other options can adjust copy quality, magnification, paper supply, type of finishing, accent color, tab operation, chapterization, selective edit, etc. When setting up a copier/duplicator for printing a multisheet document with a large selection of options available for the job, the set-up becomes even more complex by providing options for set-up on a page level basis.

In the prior art, reproduction apparatus that are capable of accomplishing complex reproduction jobs were provided with relatively complex operator control panels that appear intimidating to the casual user who either desires to have a relatively simple copying operation performed or who desires to have a more complex copying operation performed with a minimum of instruction on how to set-up same on the apparatus.

SUMMARY OF THE INVENTION

It is therefore an object of the invention to provide a reproduction apparatus suited for use by a casual operator that can perform both simple and complex reproduction jobs and is relatively "user friendly."

In accordance with the invention there is provided a reproduction apparatus for producing copy, said apparatus comprising:

an operator control panel, said panel including means including a display screen for indicating on said screen certain standard selectable features for a copying operation including copy format, paper supply source, copy quality, magnification and exit location with plural displayed options for each feature, and first means for altering the display on the screen to indicate a displayed selected option for each and generating a first set of signals representing selected options of the standard features;

means for altering the display on said screen to display various operator selectable special job level features for a copying operation available on a job level basis, and second means for altering the display to indicate displayed special selected job level features for reproducing a job comprising a multisheet document with said special job level features and generating a second set of signals representing selected special job level features;

means for altering the display on said screen to display various operator selectable special page level features for a copying operation specific to reproducing a selected page of the multisheet document job, and third means for altering the display to indicate displayed selected special page level features for reproducing said page with said special page level features and generating a third set of signals representing selection of special page level features; and means responsive to said first, second and third sets of signals for producing copy comprised of a multisheet document, said multisheet document being produced in accordance with the options selected from the standard features, the job level features and having at least one page produced in accordance with the selected page level features.

BRIEF DESCRIPTION OF THE DRAWINGS

The subsequent description of the preferred embodiments of the present invention refers to the attached drawings wherein.

DETAILED DESCRIPTION OF THE PREFERRED EMBODIMENT

Because electrophotographic reproduction apparatus are well known, the present description will be directed in particular to elements forming part of or cooperating more directly with the present invention. Apparatus not specifically shown or described herein are selectable from those known in the prior art. Particular reference is made to U.S. Pat. No. 4,740,818, the contents of which are incorporated herein by this reference.

Figure 1:
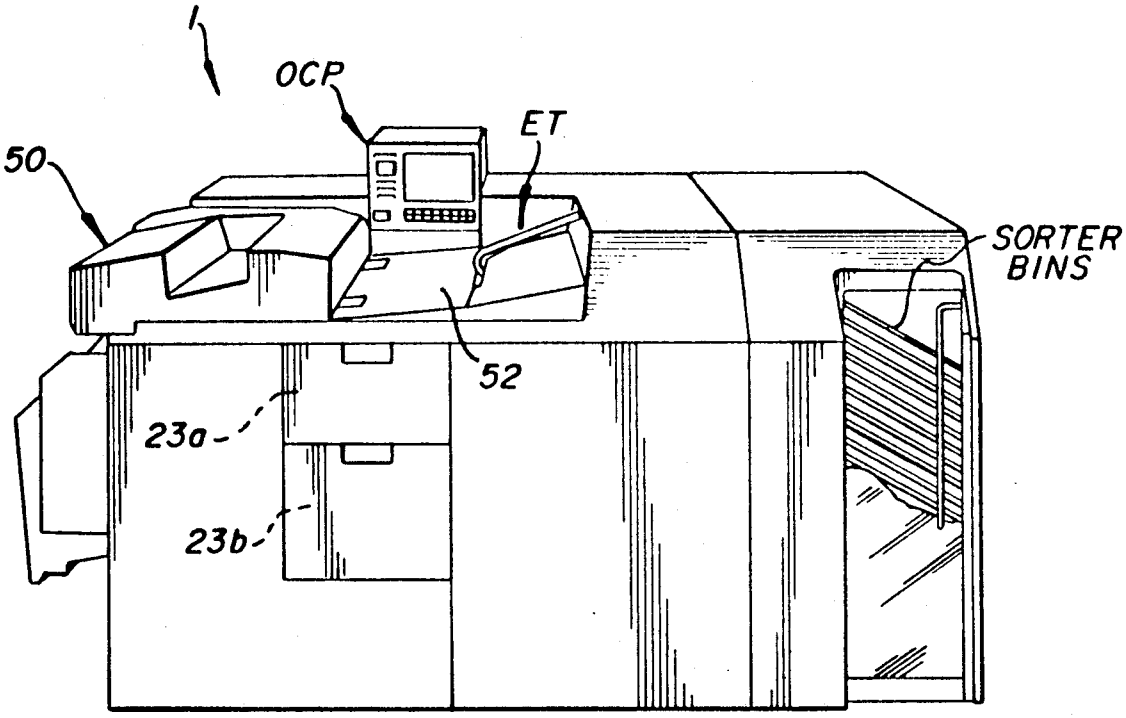
FIG. 1 is a front perspective view of a reproduction apparatus made in accordance with the invention.

With reference now to FIG. 1 there is shown an electrophotographic copier/duplicator apparatus 1 having a recirculating document feeder 50 that includes a tray portion for accepting a multisheet document original for reproduction The apparatus includes an operator control panel, OCP, which as will be described includes buttons and prompting displays for facilitating a job set-up; i.e., the input of an instruction set to the apparatus' logic and control unit (LCU) to enable it to control a series of operations resulting in a desired copy output representing a reproduction of the document originals. Copies may be produced on receiver sheets stored in either or both drawers holding trays 23*a* and 23*b*. The copy output from the apparatus is stored either in an exit tray ET or a finisher/sorter having a series of sorter bins as is well known.

Figure 2B:
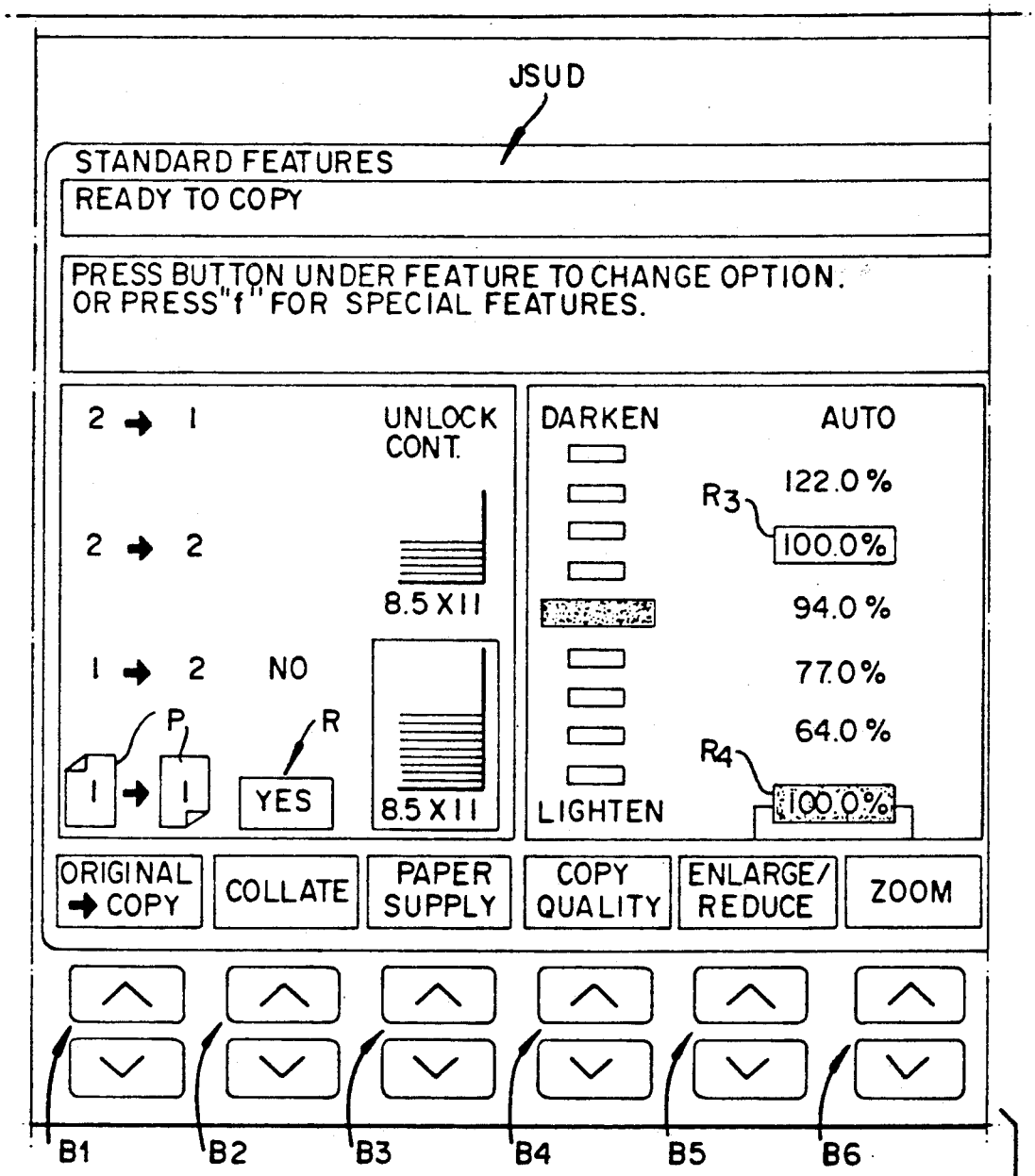
FIG. 2 is a view of an operator control panel including a display screen with the display on the screen illustrating a standard features screen.
Figure 2C:
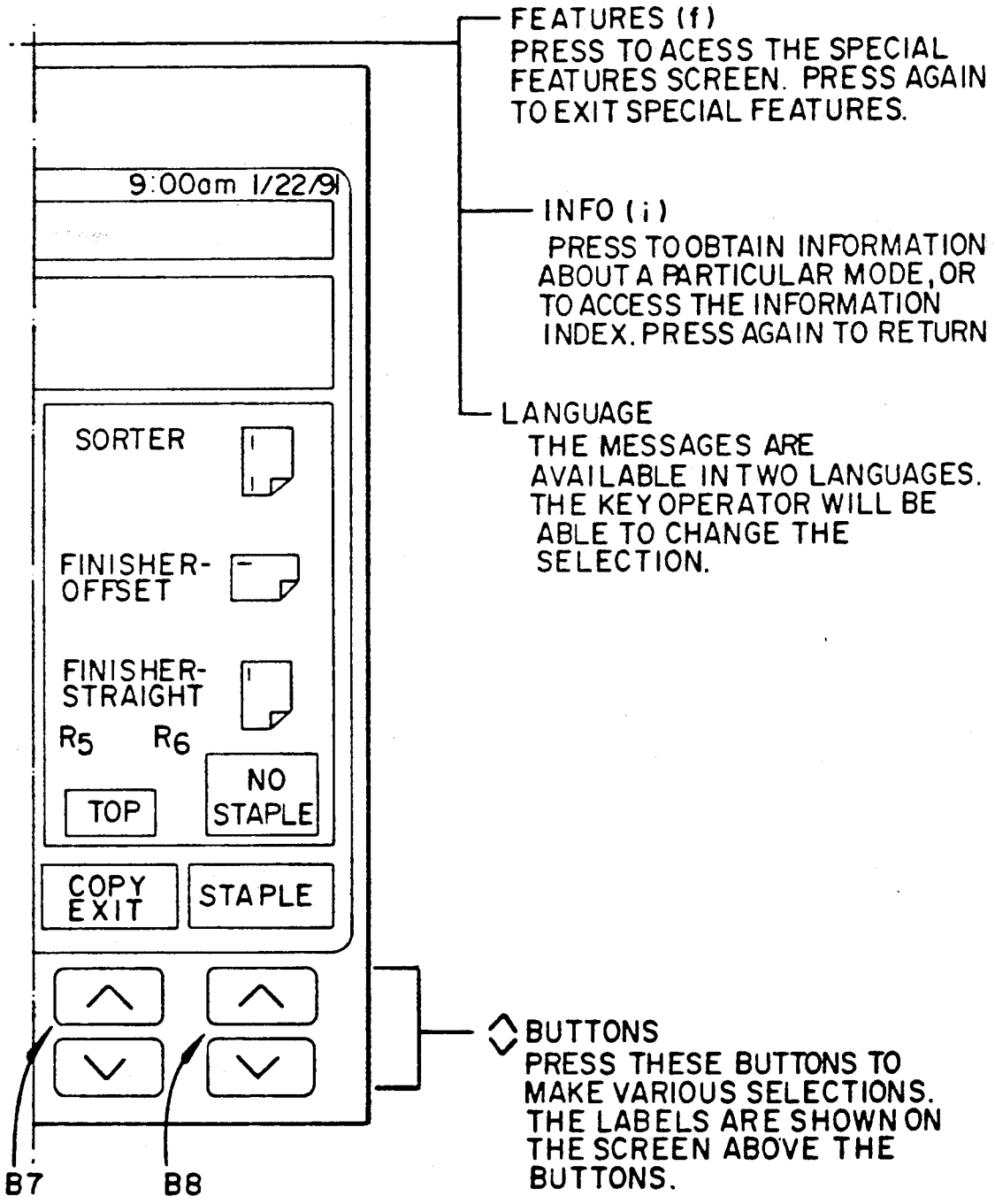

With reference now to FIG. 2 there is shown the operator control panel (OCP) which includes various buttons or keys the functions of which are described in the drawing as well as two displays including a copies numerical display (CND) and a job set-up display (JSUD). The numerical display as noted in FIG. 2 indicates the number of copies or sets requested as well as the number of copies or sets that have been completed. The job set-up display screen is a known programmable-type screen wherein the copier's logic and control includes a computer program and a bit map memory for controlling the representation that is visible on the display. The display illustrated on the JSUD display in FIG. 2 will be referred to as the "standard features display" as it displays various features that a casual user of the apparatus would want when first approaching the apparatus for an average production job. Specifically, there is provided on this display a copy format display that includes a word descriptor "original→copy" as well as a vertical list of numerals above this word descriptor representing from bottom to top a simplex(1) to simplex(1) operation, a simplex(1) to duplex(2) operation, a duplex(2) to duplex(2) operation and a duplex(2) to simplex(1) operation wherein the first word of each operation represents the format of the original document to be copied; i.e., is it a simplex document or a duplex document, and the second word represents what is desired for the copy. As used in the art, the term "simplex" refers to a document sheet having information on one side while "duplex" refers to a document sheet having information on both sides. The OCP includes button set B1 for selecting one of the four available format options. As shown, an operator selection or default selection results in the page-like pictorials P being displayed about the numerals representing the format selected. This pictorial display may be moved up or down by operation of up-down button set B1.

The next portion of the display is defined by a word descriptor "collate" and provides one of two options for selection either "yes" or "no." the operator or default selected option is contained within a displayed rectangle R. In accordance with selection of the available options either collated or noncollated copy sets will be produced. Up-down buttons in button set B2 are used to move the rectangle to either option.

The next portion of the display is defined by a word descriptor "paper supply." This allows identification of the selection of the paper drawer from which copies are reproduced. The selectable options using up-down buttons B3 are lower drawer, upper drawer and unlock, to unlock the selected drawer. A rectangle surrounds the selected option. The two paper supply drawers are illustrated with a pictorial representation of a stack of sheets as well as numerical identifiers for the paper size stored in each drawer. The paper size and approximate number of sheets remaining in each drawer are sensed by sensors associated with the trays in each drawer and which provide signals to the apparatus' LCU. The LCU's program control outputs appropriate signals to the bit map memory of the display. Driver signals from the bit map are fed to the display to illuminate the matrix display in accordance with the signals in bit map memory.

The next portion of the display is defined by the word descriptor "copy quality" and includes a vertical series of rectangles all of which are hollow but for one which is solidly filled. The words "lighten" and "darken" appear respectively below and above this series to identify that selections to one side of the larger rectangle in the middle of the series progressively request copies to be lightened whereas selections to the other side of this rectangle request progressively darker copies. Up-down button set B4 is used to input signals representing a request to color a desired lighten-darken setting. As with all the up-down buttons, the signals generated by pressing each one represent a request or input to the LCU to change the display by one increment for each depression of the button in the desired direction. The LCU may have a program that allows a depression of a button to scroll from a top most option directly to a bottom most option when the up button is pressed. The down button may be also programmed to scroll directly from the bottom-most option to the top-most option.

The next portion of the display is defined by the word descriptor "enlarge/reduce" and the remainder of the display relative to this depicts a vertical series of fixed magnification numbers. As used herein the term magnification can refer either to enlargement or reduction depending upon the context. As shown a rectangle R3 surrounds a selected or defaulted to magnification setting in this case 100.0% which represents reproduction of copy at a one to one size relationship. Also in the series of selectable items is an "auto" setting which when selected provides for automatic setting of the taking lens 7 of FIG. 5 to a magnification related to the original document size as sensed using sensors in the feeder and the paper supply selected. Up-down buttons B5 allow the operator to input selections of a desired magnification setting. The selected magnification is also illustrated in a solid rectangle box R4 which is also associated with a next portion of the display defined by the word descriptor "zoom." Using up-down buttons B6 the operator may input a desired magnification that is in say 0.5% increments over the entire available magnification range.

The next portion of the display is defined by the word descriptor "copy exit" which serves to define the location of sending of the reproductions. Thus, the available options are indicated for the top exit tray, the finisher tray with sets straight on top of each other, the finisher tray with sets offset from each other, and the sorter. Using up-down buttons B7 a rectangle display will be formed about the selected word location describer.

The next portion of the display is defined by the word descriptor "staple" which serves to define the type of stapling operation to be performed by the finisher/-sorter. A vertical series of pictorials illustrate the orientations of possible staple positions for the reproduced copy sets including "no staple" which is indicated as being selected by a rectangular box surrounding same. It should be noted that the LCU has a program allowing a so-called key operator to control through selected inputs by such operator various default settings. Operator selection of staple position is provided using buttons B8.

It will be noted that the JSUD display in combination with the CND display provides sufficient display of the standard features to facilitate input of an average copying job to be requested by a casual user of the apparatus. The standard features display includes additional word instructions and information as illustrated including instructions to press a features button "f" for special features. Other buttons associated with the display are illustrated and functional descriptions thereof provided in FIG. 2.

Figure 3:
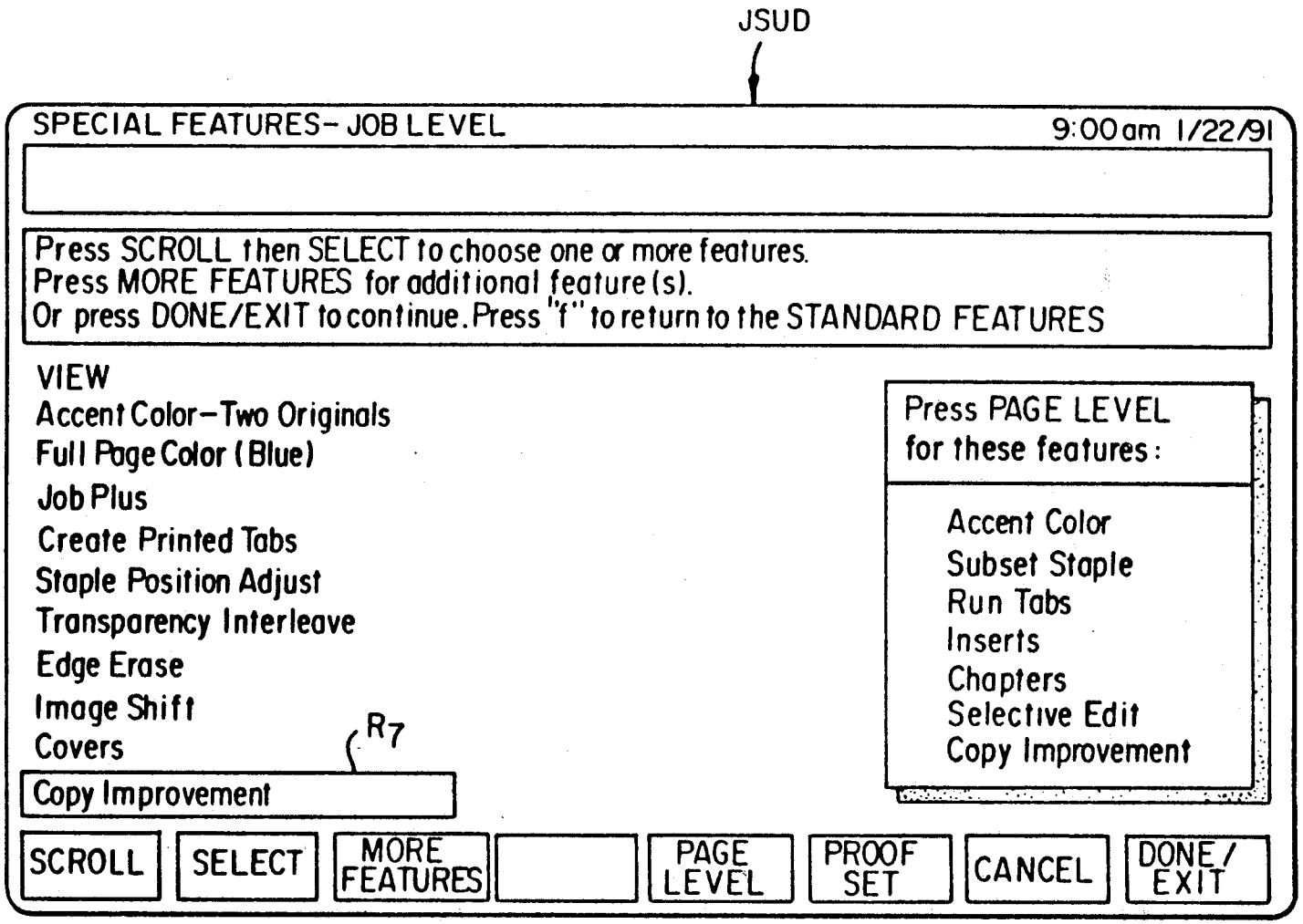
FIG. 3 is a view of the display screen with the display on the screen providing word descriptions of selectable job level features.
Figure 6B:
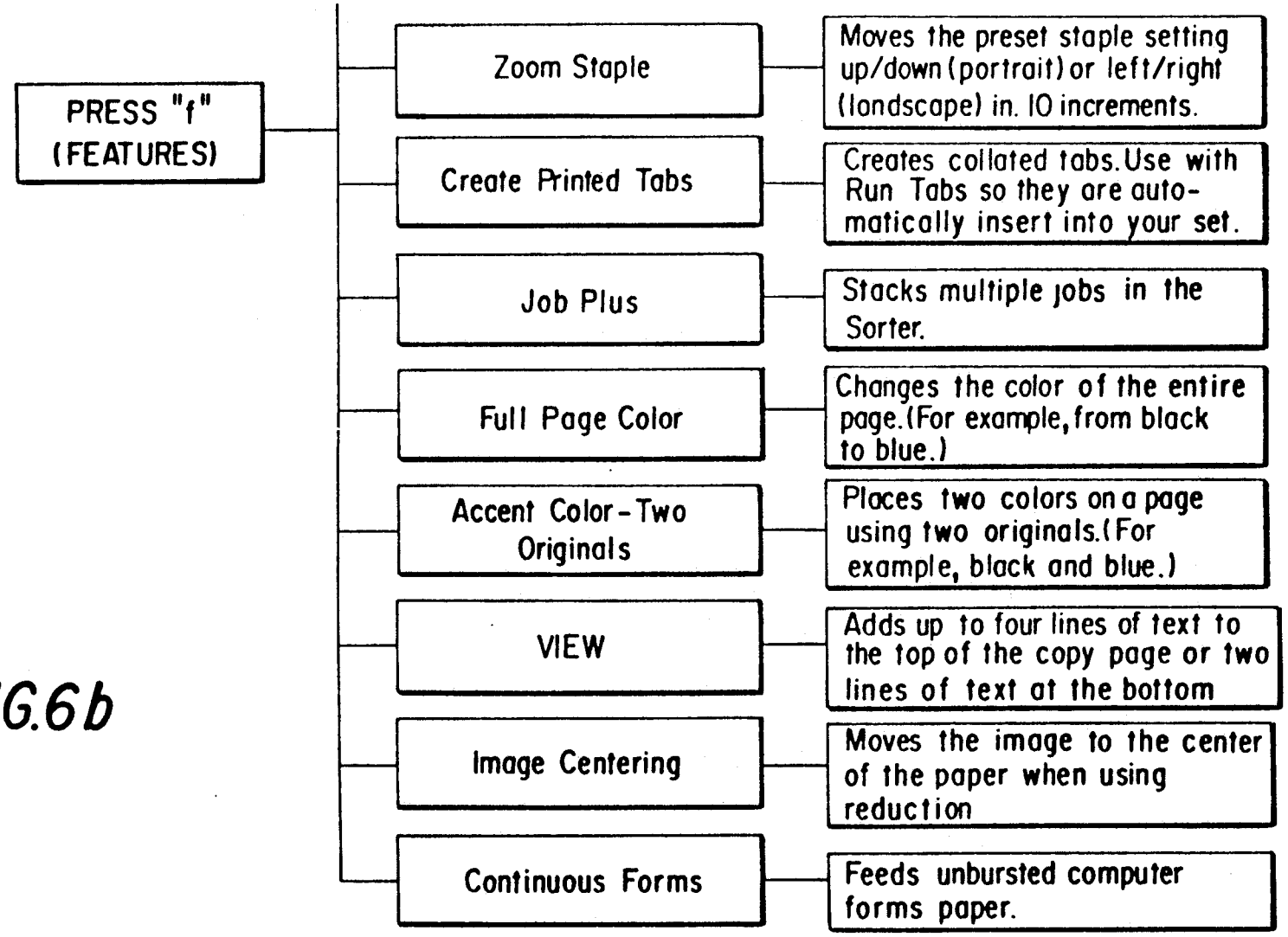
FIG. 6 is a chart illustrating various special features available on a job level basis and providing a description of each feature.
Figure 7B:
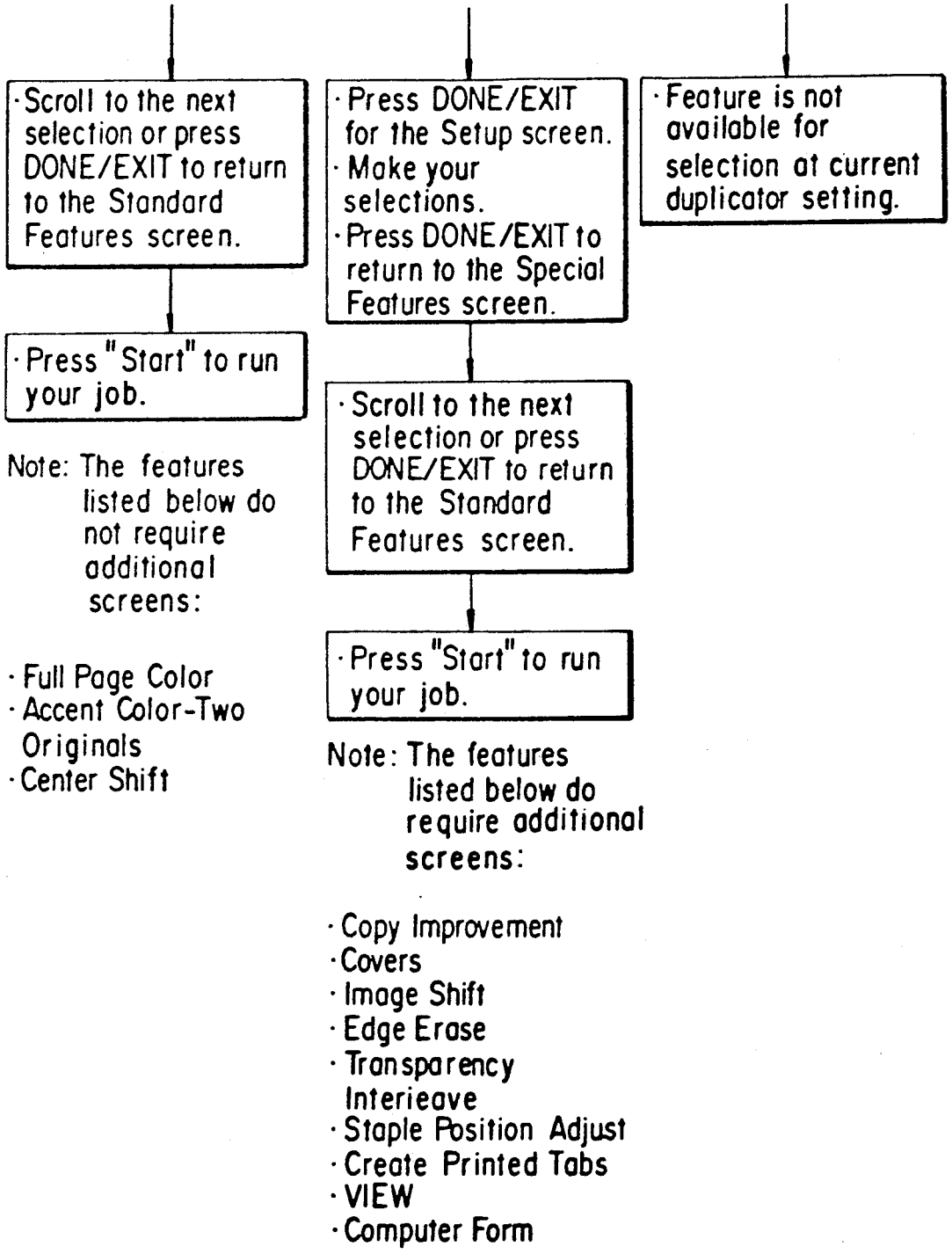
FIG. 7 is a flowchart explaining the use of the displays for selecting various features on a job level basis.
Figure 8A:
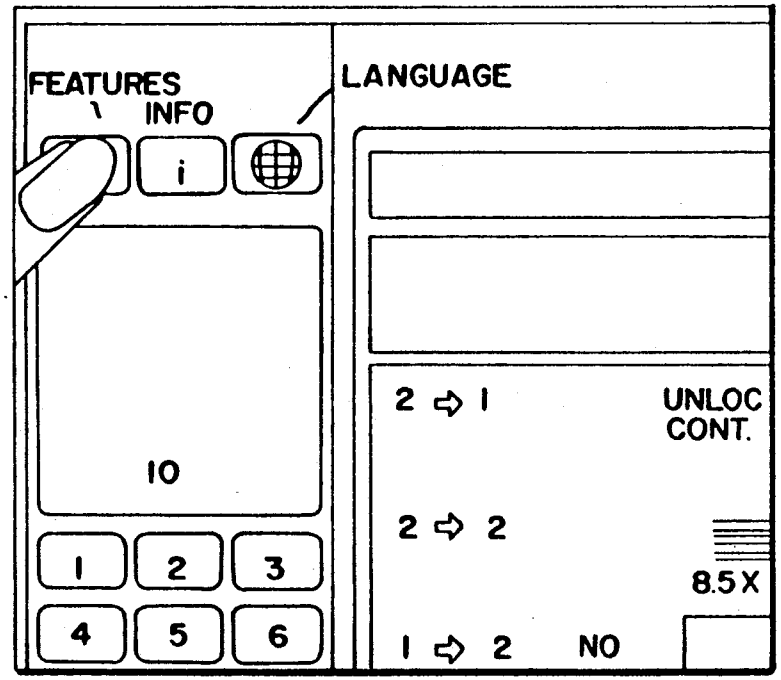
FIGS. 8 (*a–h*) describe and illustrate a series of steps for selecting a specific job level feature.
Figure 8B:
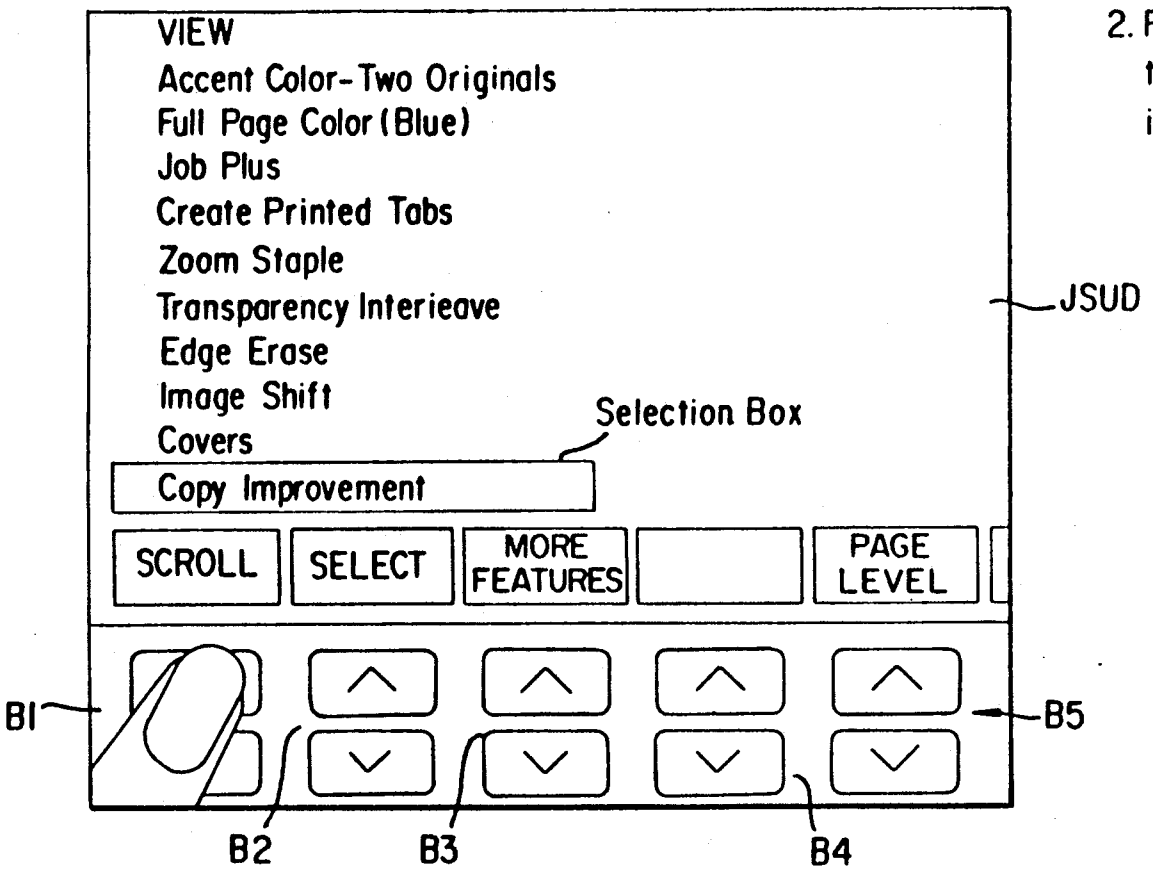
Figure 8C:
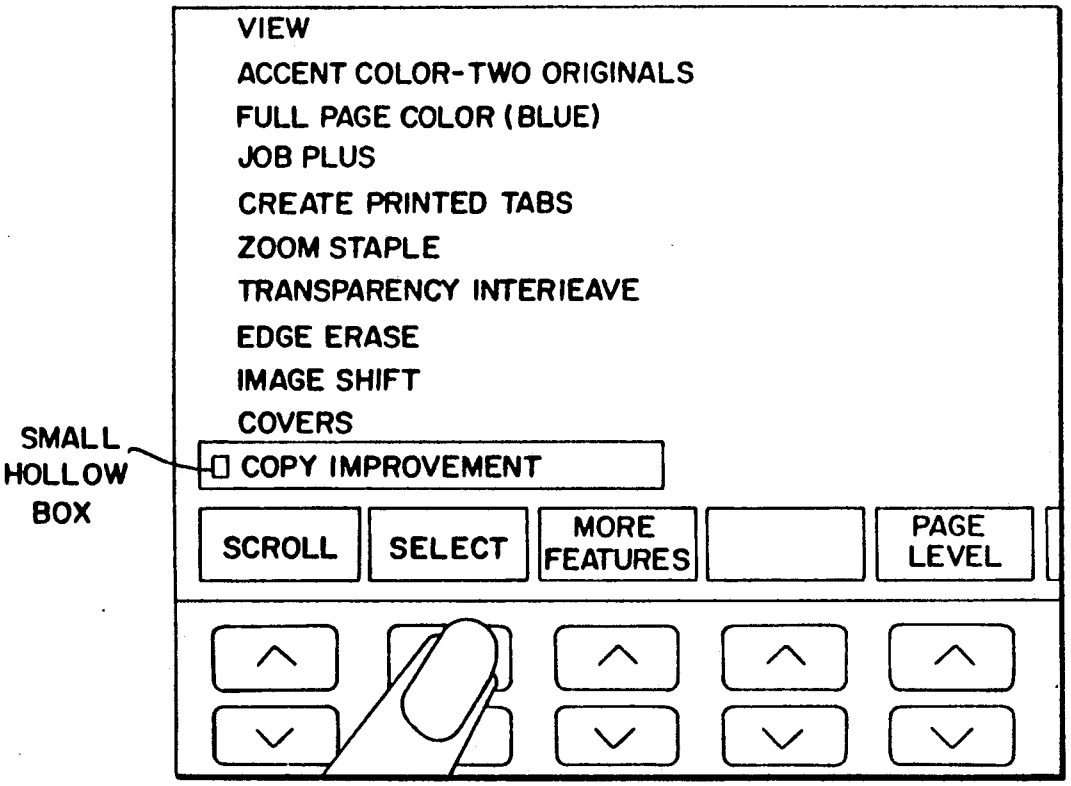
Figure 8D:
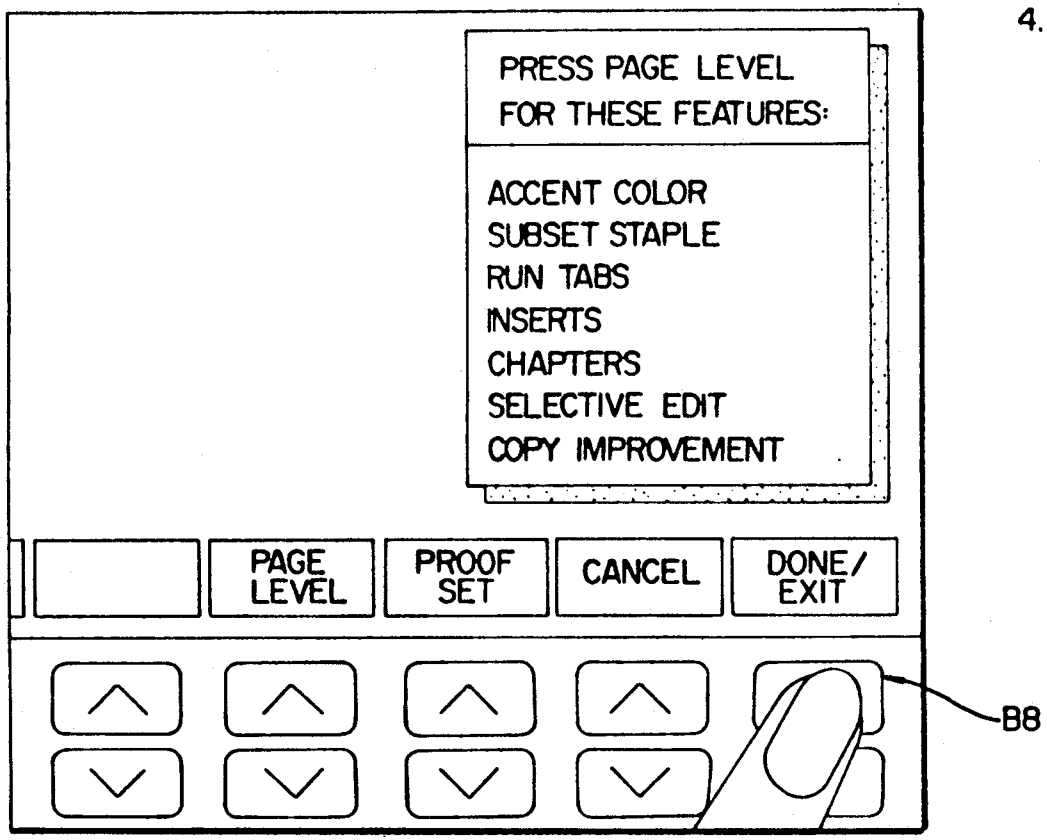
Figure 8F:
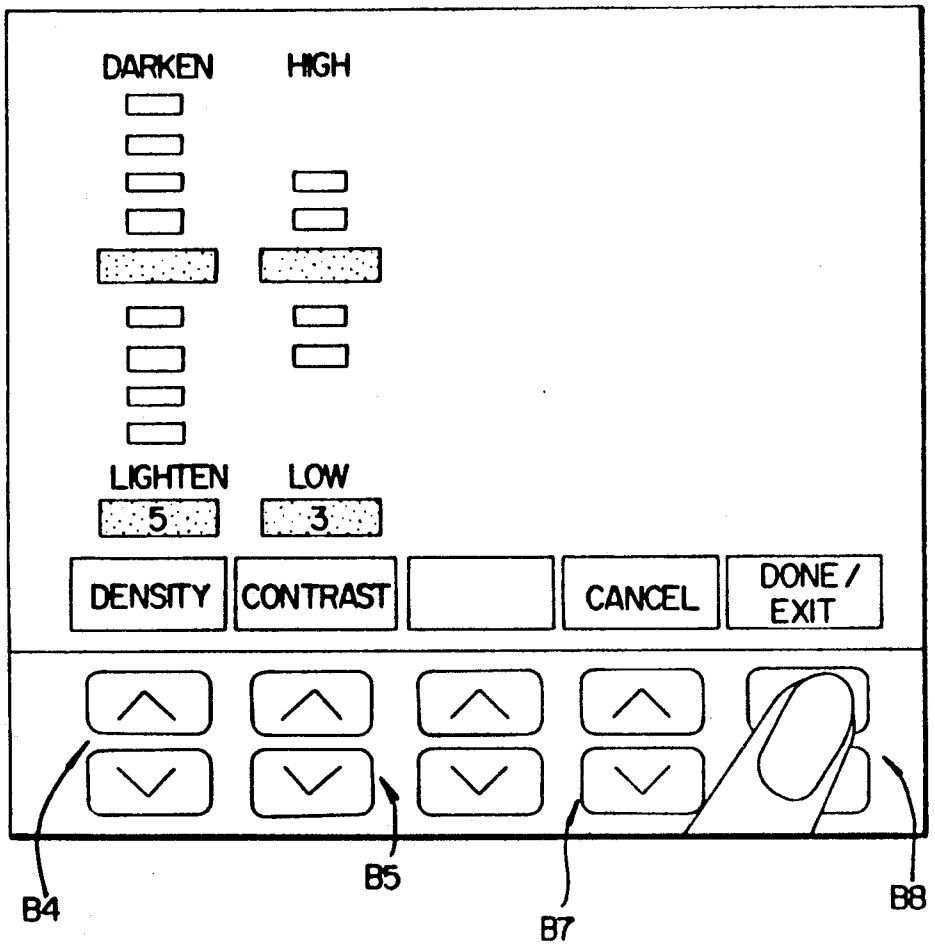
Figure 8G:
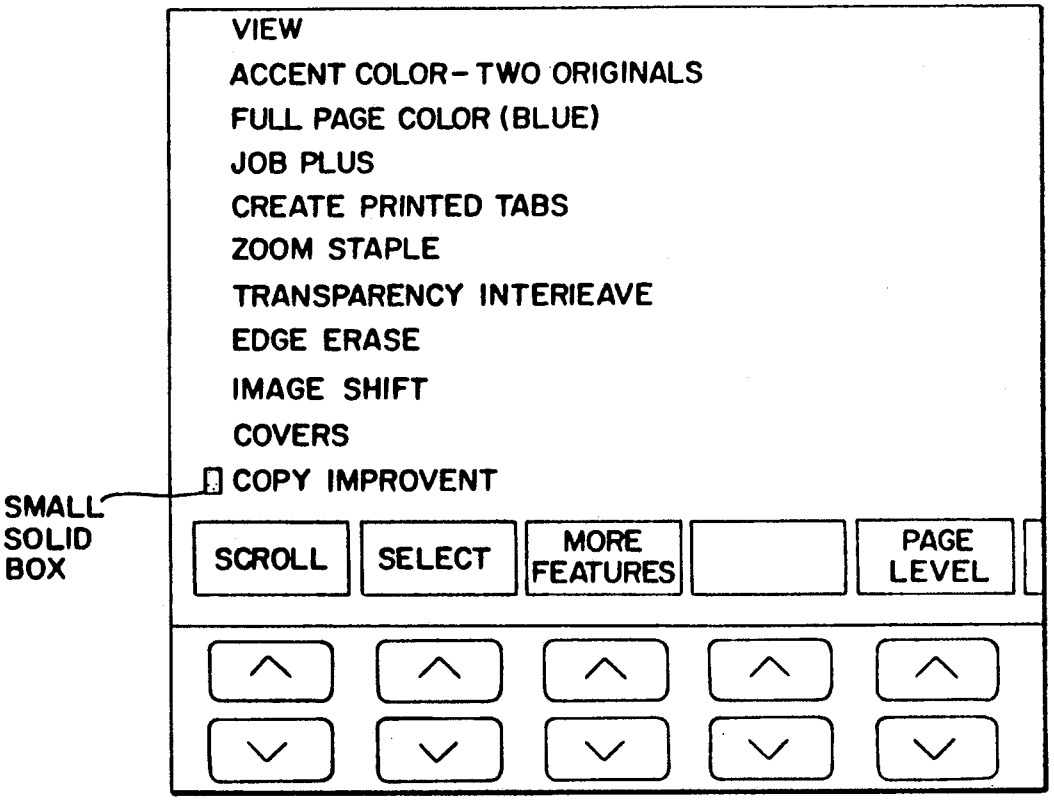
Figure 8H:
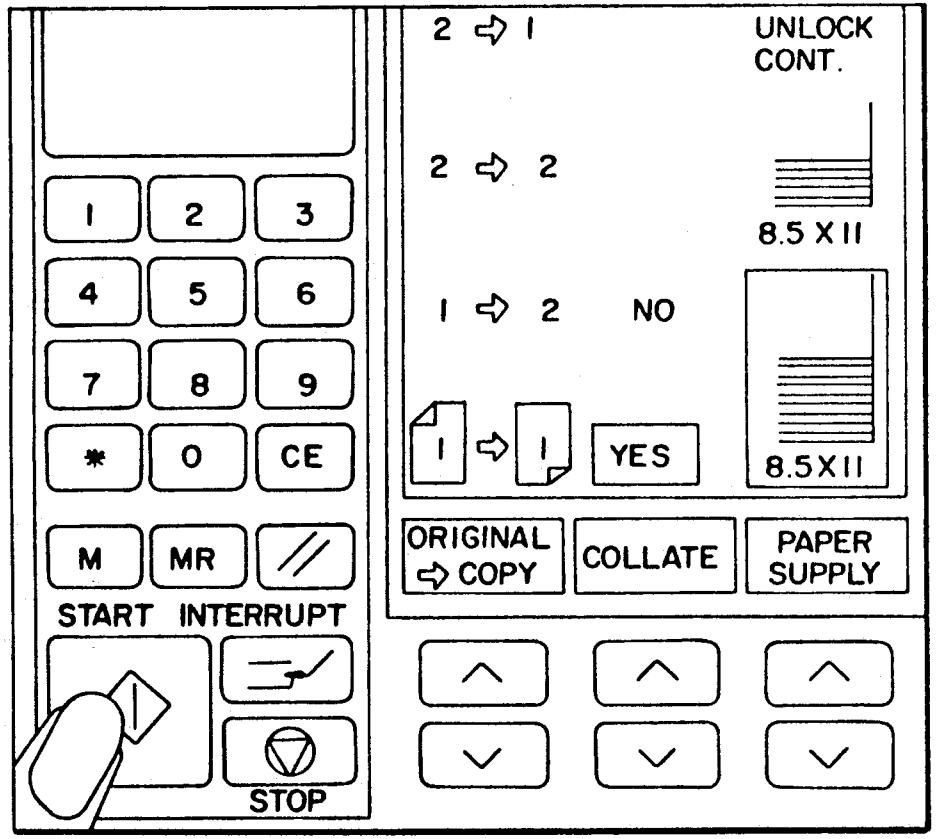
Figure 9A:
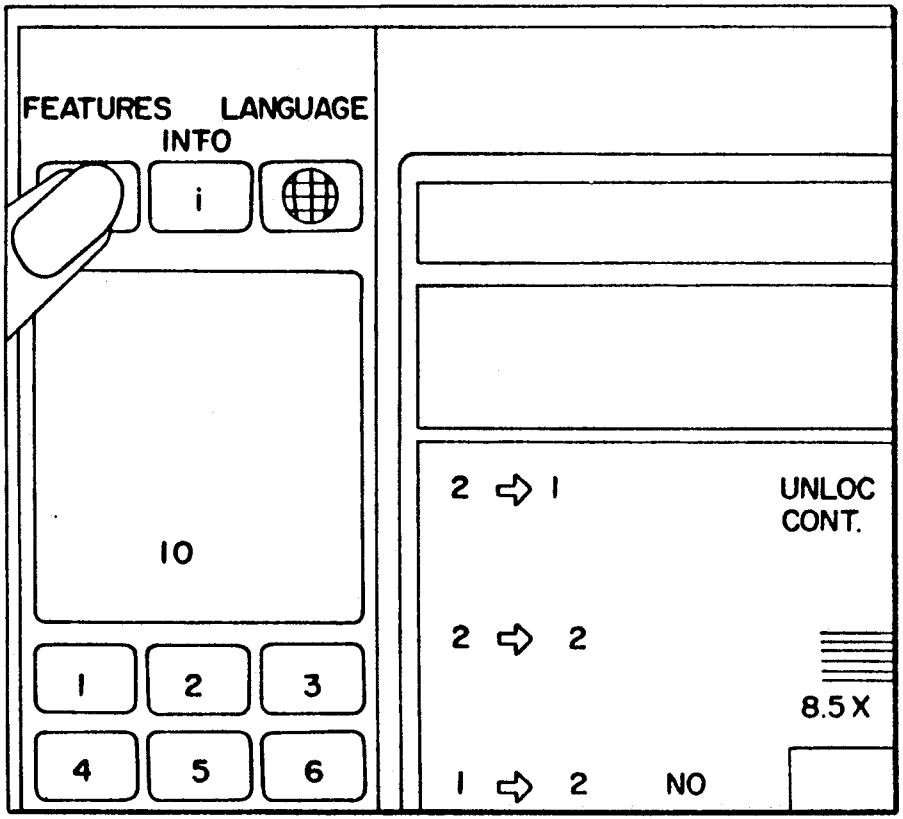
FIGS. 9 (*a–i*) describe and illustrate a series of steps for selecting a specific page level feature.
Figure 9B:
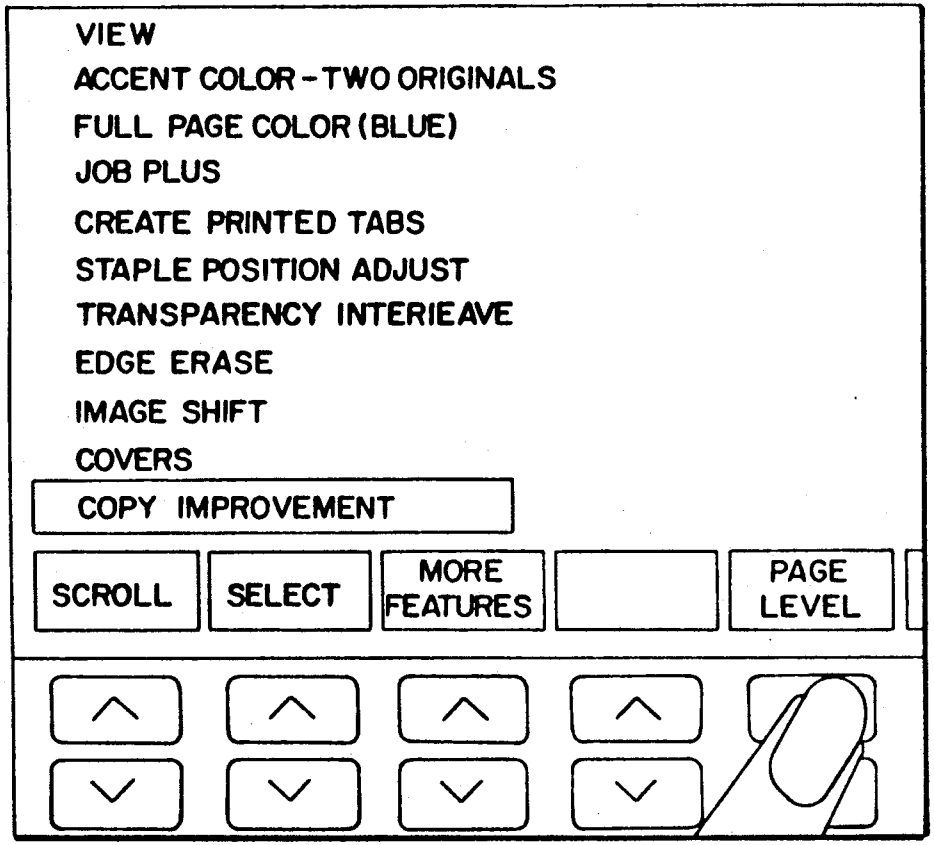
Figure 9C:
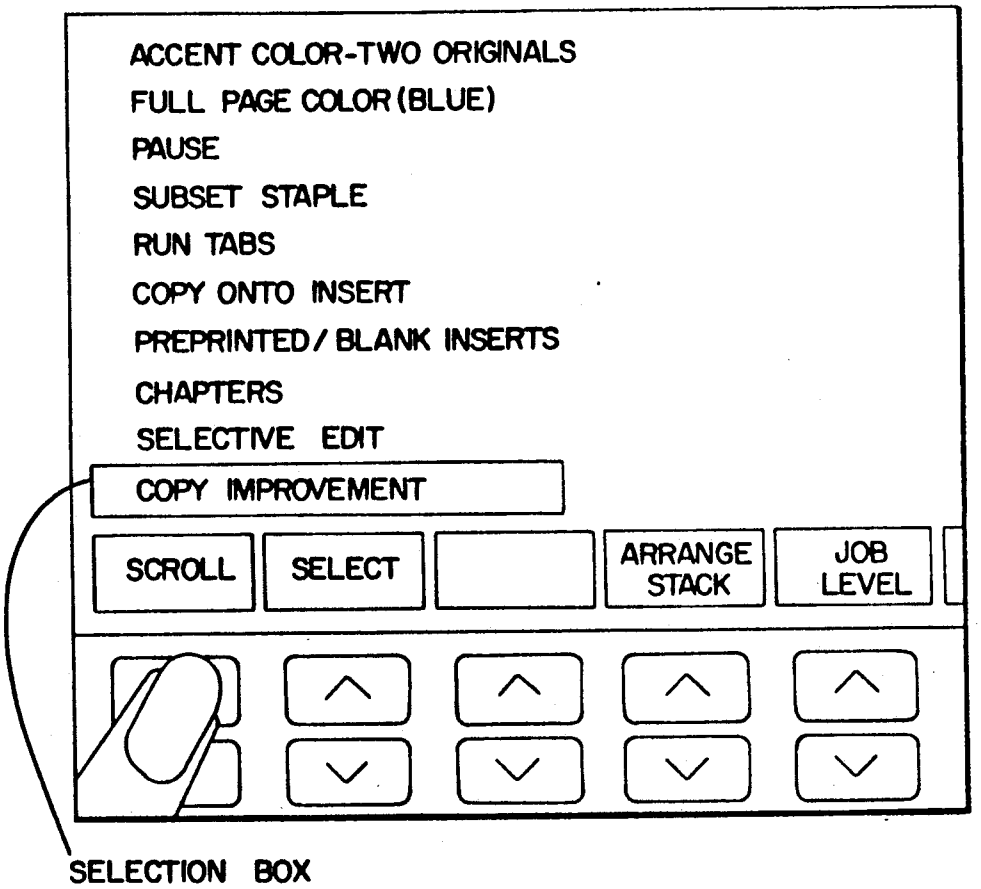
Figure 9D:
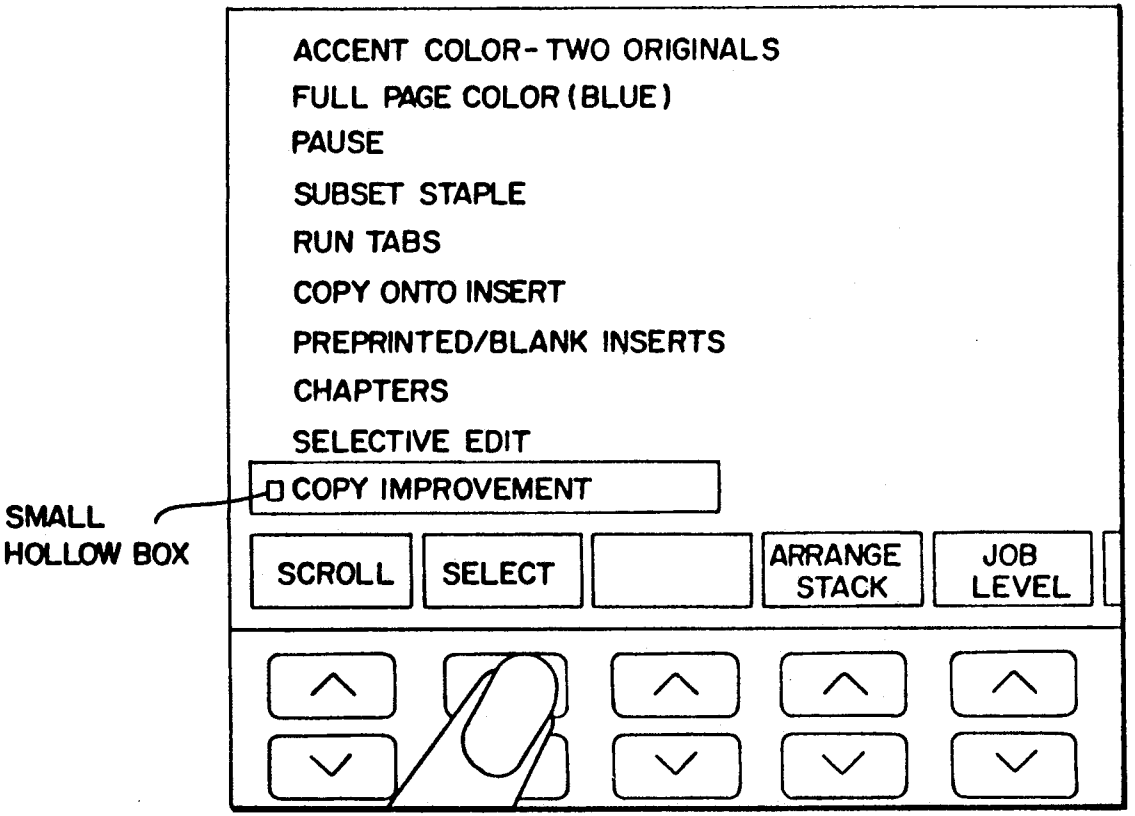
Figure 9E:
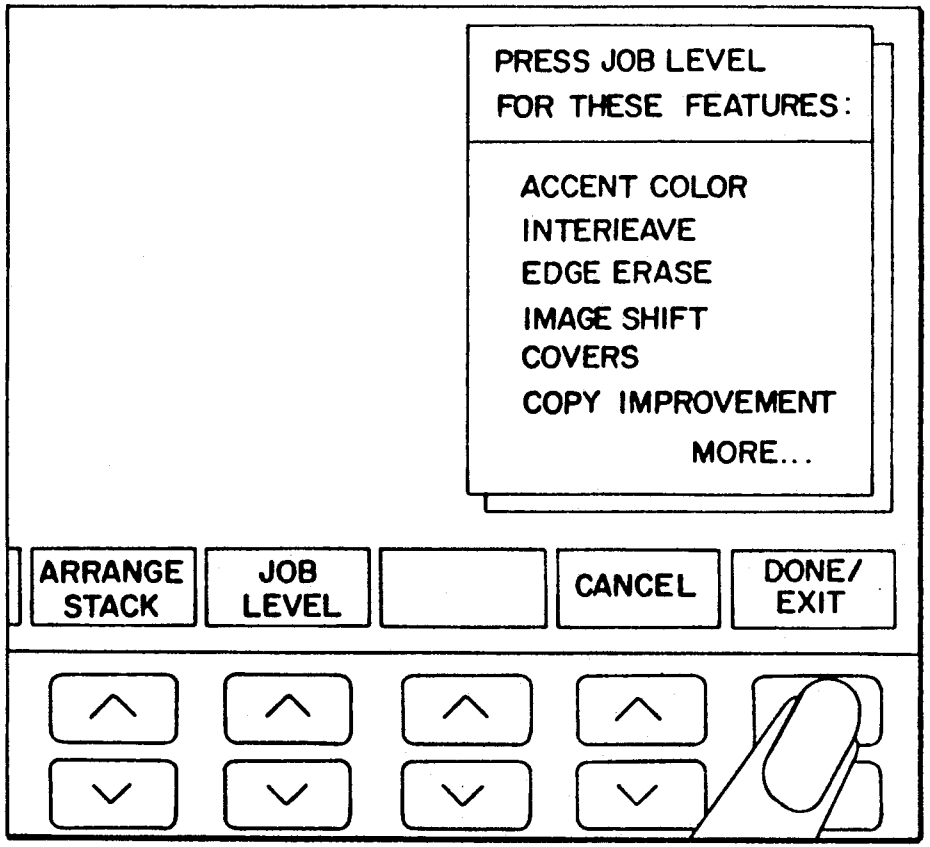
Figure 9G:
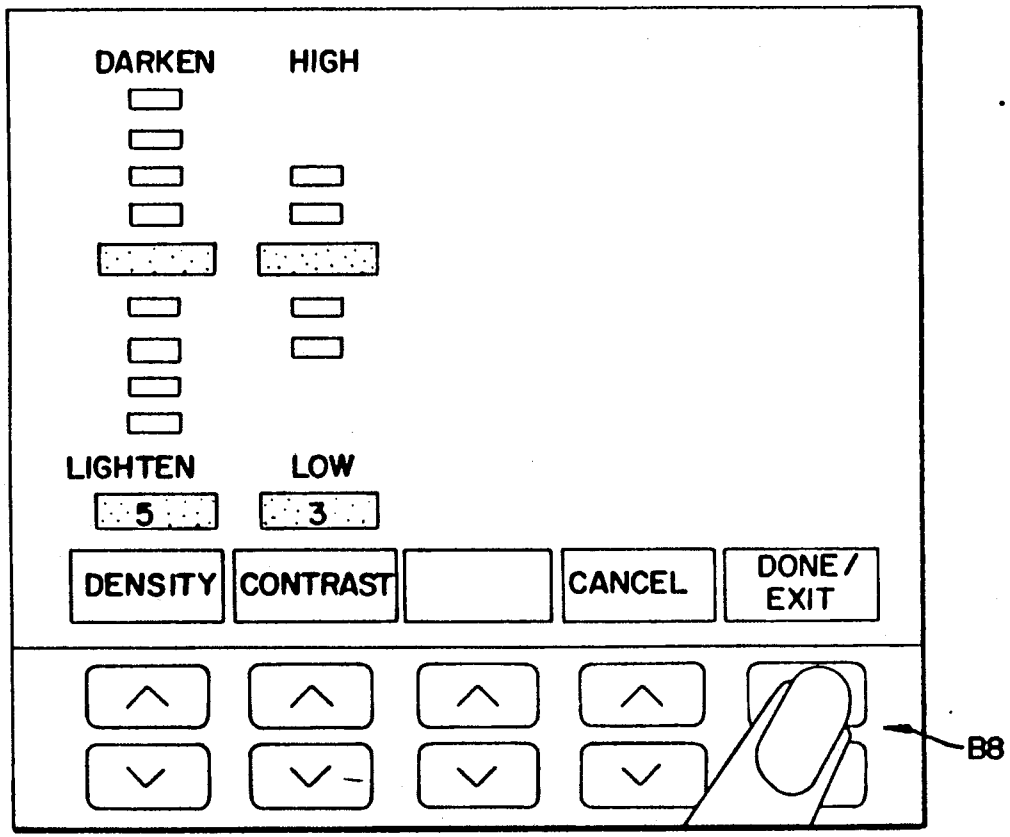
Figure 9H:
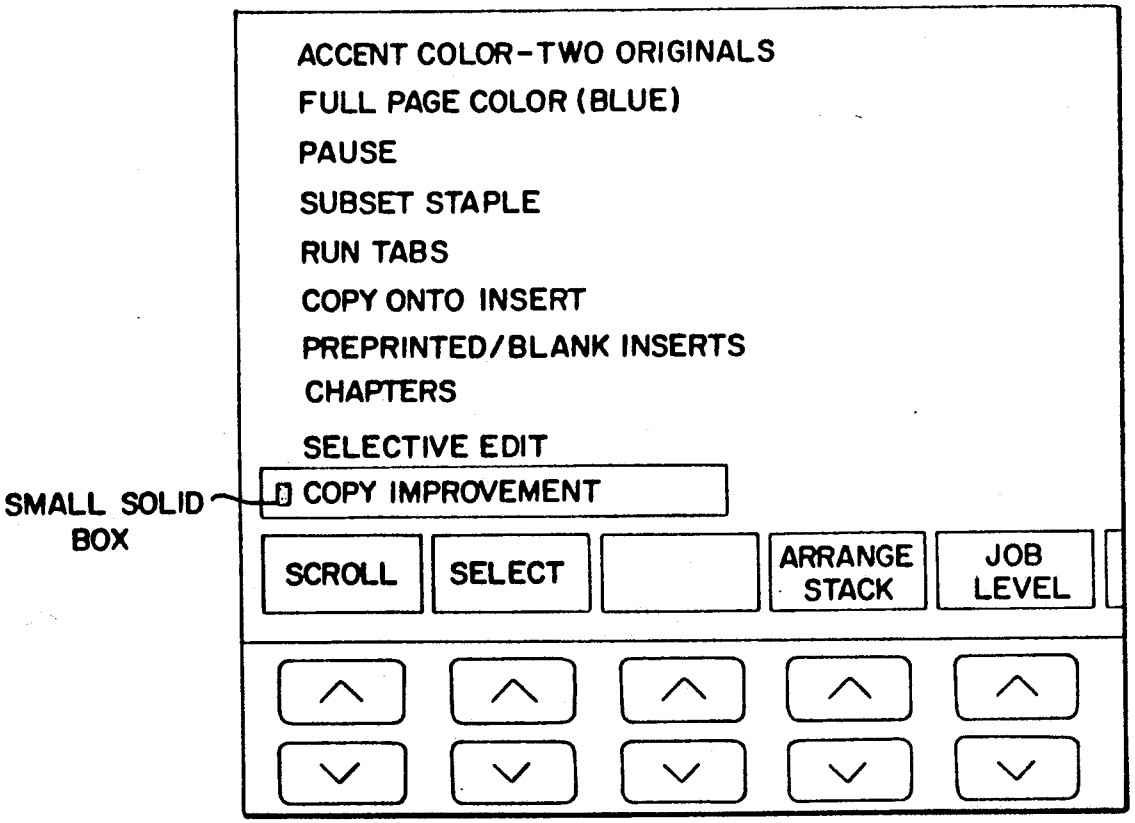
Figure 9I:
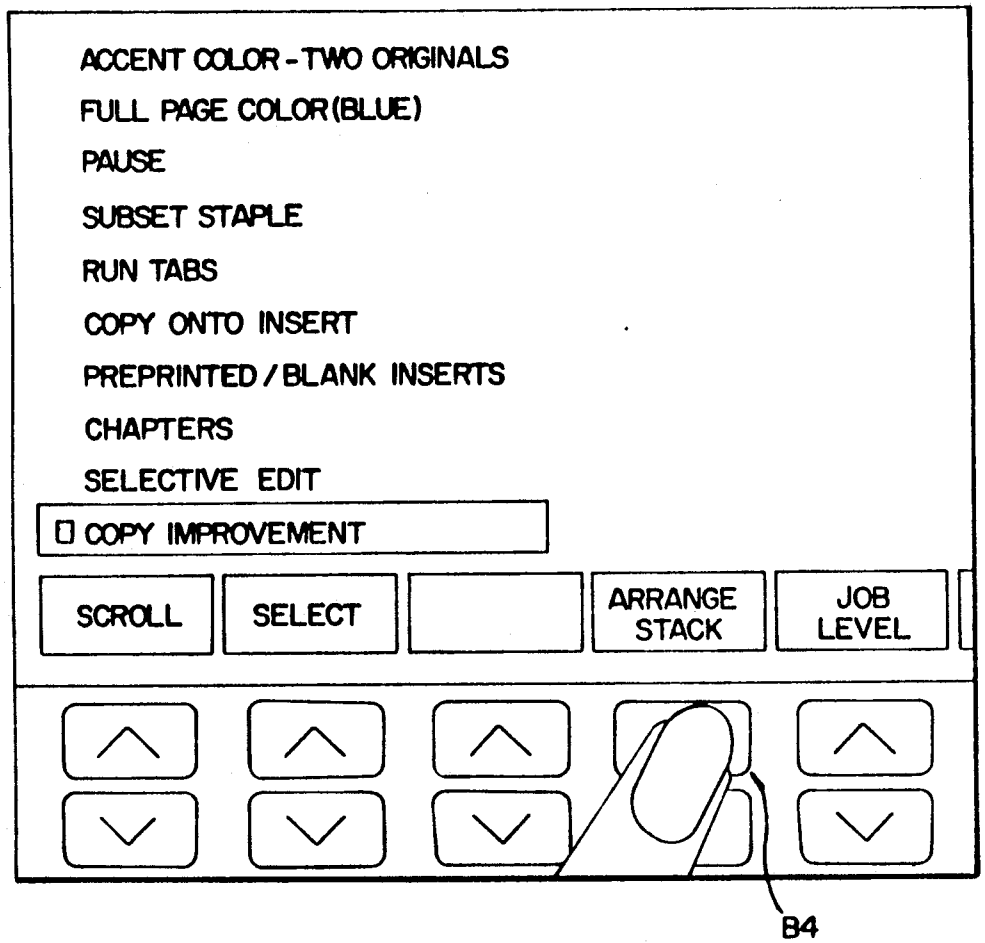

Upon pressing of the features button "f" or perhaps the combination of button inputs "*f" a screen display as illustrated in FIG. 3 is called up on the JSUD display from the stored program in the LCU. The JSUD display of FIG. 3 now includes a vertical arrangement of word descriptions of selectable special features that are available on a job level basis. As may be noted, a rectangle is illustrated about the words "copy improvement" which indicates this is currently being considered for selection. With reference to FIG. 6, a chart is provided indicating the various possible selections and a description of each. FIG. 7 provides a flowchart relative to use of the screens and notes the concept of the different steps involved in making of a selection which will now be described with reference to FIGS. 8 (*a–h*) showing the steps involved in selection of a copy improvement feature for the current job being set up.

Figure 5:
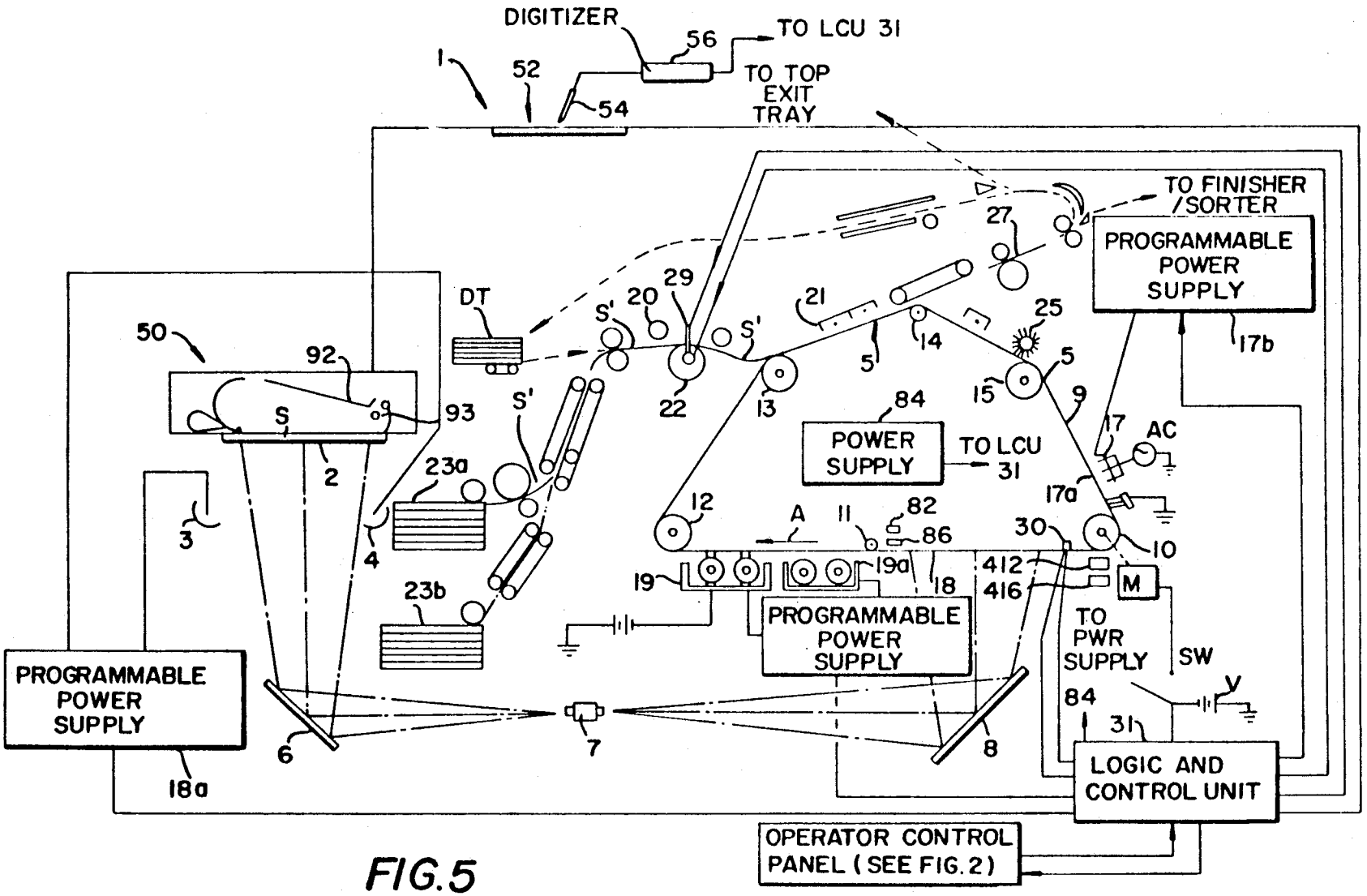
FIG. 5 is a schematic of an electrophotographic reproduction apparatus for making copy in accordance with inputs provided using the screen displays.

As noted in FIG. 8 (*a–h*), the feature designated "copy improvement" includes several selectable options for improving copy quality in a reproduction job being set for copying. Thus density, contrast or the addition of a screen to the copy may be modified in accordance with the following procedure for setup. In FIG. 8 (*a*), the "f" button is pressed when viewing the standard features screen to call up the special features screen illustrated in FIG. 3. Next one of the buttons B1 are pressed which now have the "scroll" function as indicated by the word description on the JSUD display above the buttons B1. As may be seen in FIG. 8 (*b*) scrolling to the option "copy improvement" in response to depression of the scroll button causes signals generated by this button to the LCU to indicate via its stored program that the bit map for the JSUD should now be altered to effectively place a rectangle about the words "copy improvement". Alternatively, the special features screen may be defaulted to place a rectangle about "copy improvement" immediately upon calling up of the special features job level screen. In any event, this indicates to the operator that copy improvement is the item for which further inputs will pertain when the other buttons are pressed. To select "copy improvement" one of the buttons B2 now identified on the JSUD screen as "select" may now be pressed to indicate selection of the copy improvement feature, FIG. 8 (*c*). Upon pressing of the button B2 below, "select", a small hollow box appears within the rectangle to confirm the selection. This hollow box as noted in the flowchart of FIG. 7 indicates that further inputs using other screens are necessary, when selecting this option. In order to see these further options the button group B8 is now pressed and these now used to input a "done/exit" signal function as indicated by the JSUD (see FIG. 8(*d*). This causes the LCU to call up signals representing a further special features job level screen that provides further options for selection within the "copy improvement" option. The "scroll", "select" and "done/exit" functions are retained at all levels in the special features screen displays to facilitate user friendliness to the casual operator. As may be seen in FIG. 8 (*e*), the various selectable options within "copy improvement" include "density or contrast", "photo screen", "light original/pencil." Again, using a button B1 to scroll a rectangle surrounds the selection scrolled to, in this case, "density or contrast." A button in button group B2 is pressed to "select" this option. Then density and contrast may be adjusted using buttons in respective button groups B4, B5 with reference to the respective displays for them. Lastly, the "done/exit" button in button group B8 is pressed FIG. 8 (*f*). After pressing the "done/exit" button B8 in the step indicated by FIG. 8(*f*), the special features job level screen display is called up again, but on this occasion a small solidly colored box is present adjacent the words "copy improvement" thus indicating a selection in which no further information relative to this feature is required, FIG. 8(*g*). Other special features may be selected using the special feature-job level display screen in similar manner and some of these features will have auxiliary screen displays called up in similar manner to that illustrated for copy improvement. Pressing of the "done/exit" button will now cause the standard features screen display, FIG. 8(*h*) to be called up on the JSUD. Thus, as shown, the "done/exit" command causes screen displays to change from layer to layer in either direction; i.e. higher level screen vs. lower level screen, in accordance with the logical direction one would expect. A copying operation may be begun using this feature by pressing the "start" button and all copies will be reproduced using the selected copy improvement function wherein density and contrast are adjusted as indicated. With reference to FIG. 5, a schematic of the various operating stations within the copier/duplicator apparatus are illustrated. This apparatus with numeral designators is substantially similar to that of FIG. 2 of the incorporated-by-reference U.S. Pat. No. 4,740,818 except that the apparatus of FIG. 5 includes an additional development station 19*a*, two paper supplies 23*a*, 23*b* a duplex tray DT and associated means for feeding copy sheets from the respective trays in accordance with well known principles. Additionally, a digitizer is illustrated in FIG. 5. Thus, the paper supply trays 23*a*, 23*b* may be alternatively selected to feed appropriate type sheets stored therein and requested in accordance with a particular job setup. The duplex tray as is well known receives fused intermediate copies that are to receive an image on a second side by feeding same a second time to the toned image recording photoconductive surface 9 of web 5 with the opposite surface of the sheet in transfer engagement with the surface 9. Briefly, a photoconductive web 5 has a surface 9 charged to a suitable controlled potential $V_o$ by charger 17 and is then exposed to illumination of a document using energized exposure lamps 3,4. The level of exposure $E_o$ and charge $Y_o$ are controlled in accordance with the density contrast settings provided by the copy improvement setup. The recirculating feeder 50 feeds the documents to be copied seriatim to the transparent exposure platen 2 and the exposure of each document original is timed in accordance with the movement of the web 5 as sensed by sensors or encoders 30 providing signals to the LCU 31. Exposures may be also made using an electronic exposure source such as an LED bar 416 and gradient index lens array 412 in accordance with signals provided from the LCU. After exposure of an image frame, the latent electrostatic image formed may be developed with toner at one of the magnetic brush development stations 19, 19*a*, one of which may have black toner and the other, say, a blue colored toner. The image is then transferred to a copy sheet S' fed from either tray 23*a*, 23*b* or the duplex tray DT and fused at fuser station 27. Subsequently, the copy sheet is now fed to either the top exit tray or the finisher/sorter in accordance with well known techniques and apparatus. Other portions of FIG. 5 not specifically mentioned herein are described in the aforementioned incorporated-by-reference U.S. Pat. No. 4,740,818. Thus, all reproductions are made using the selected "copy improvement" option.

Figure 4:
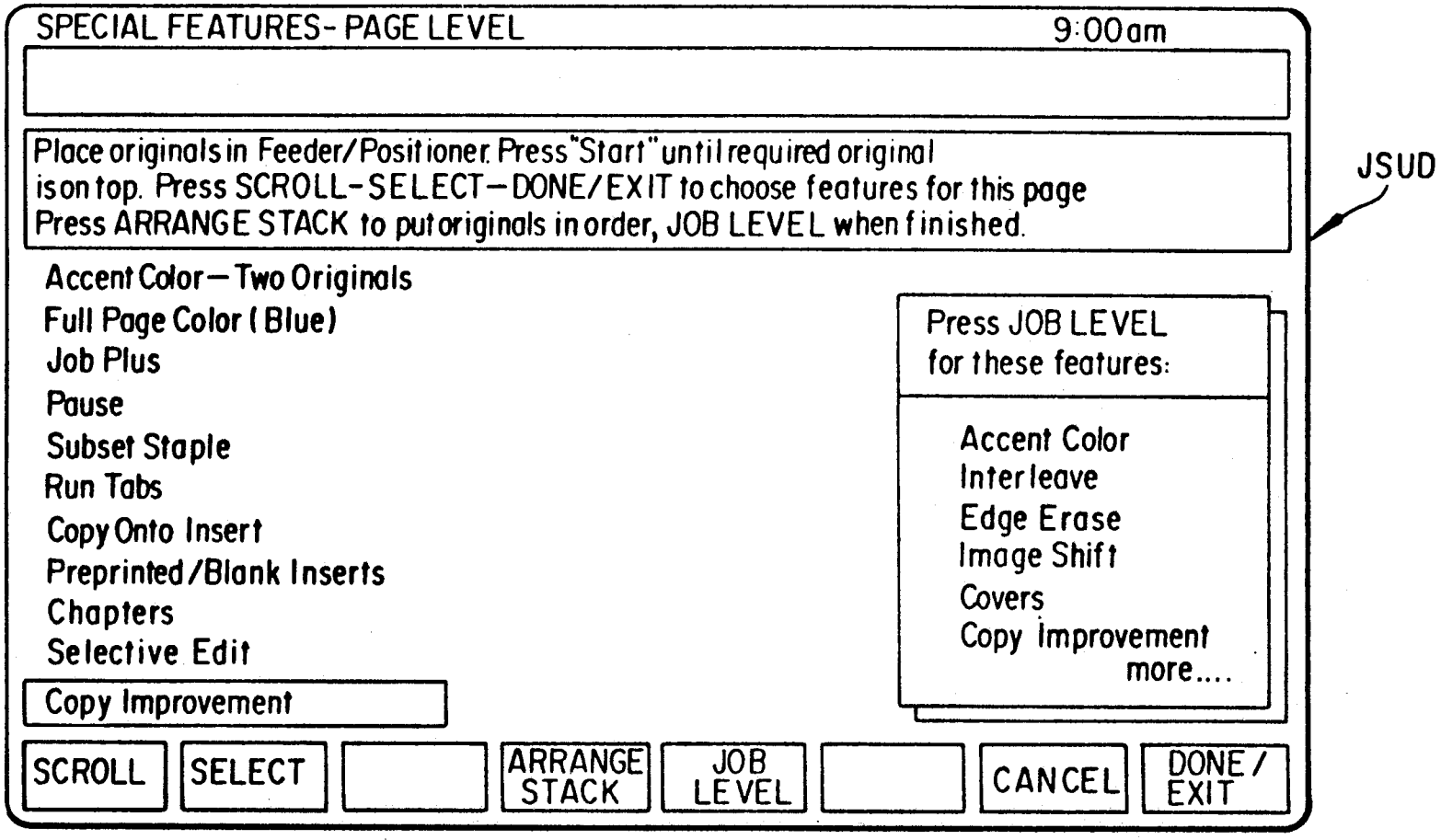
FIG. 4 is a view of the display screen with the display on the screen providing options for page level features.
Figures 10, 10A:
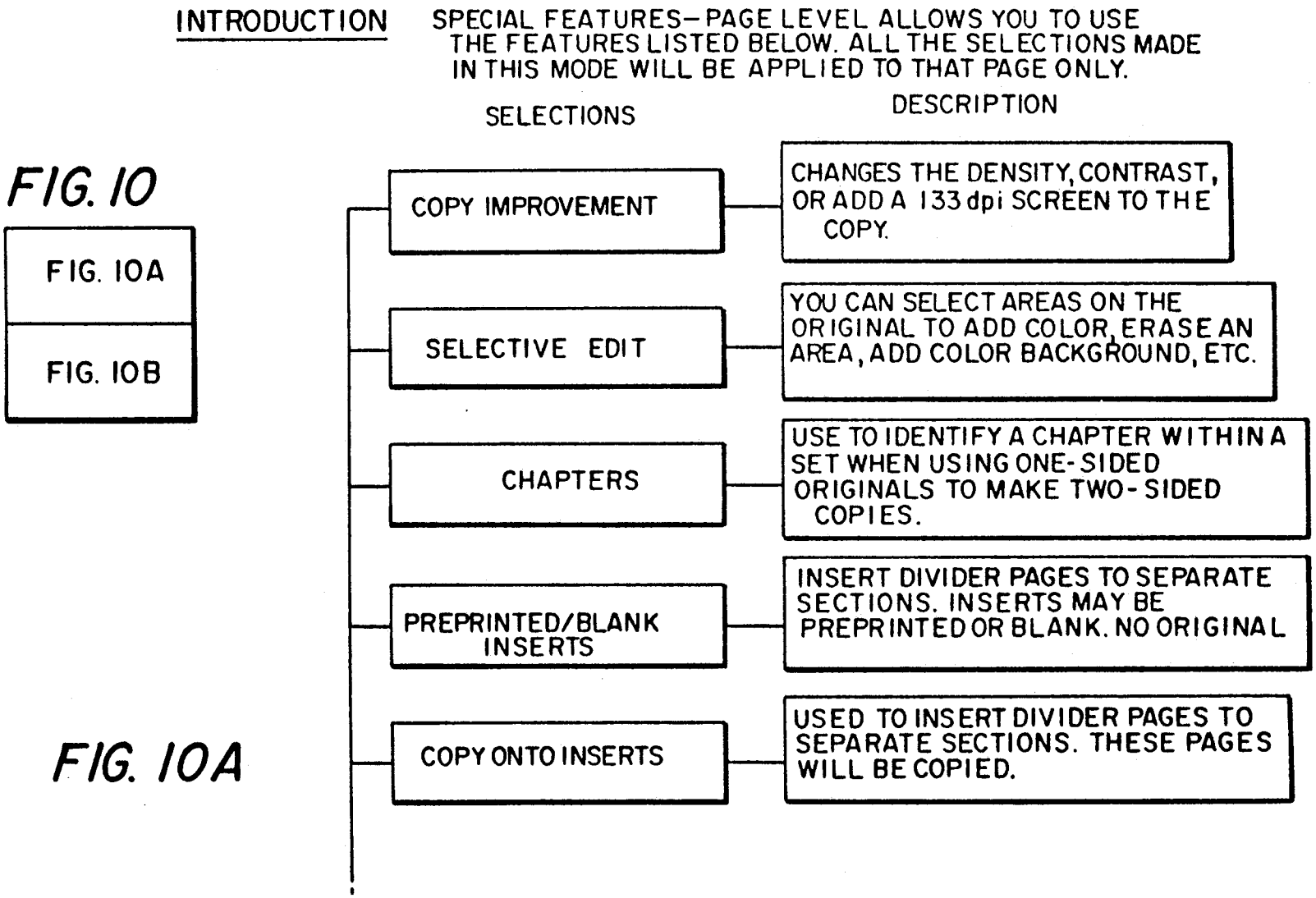
FIG. 10 is a chart illustrating various special features available on a page level basis and providing a description of each feature.
Figure 10B:
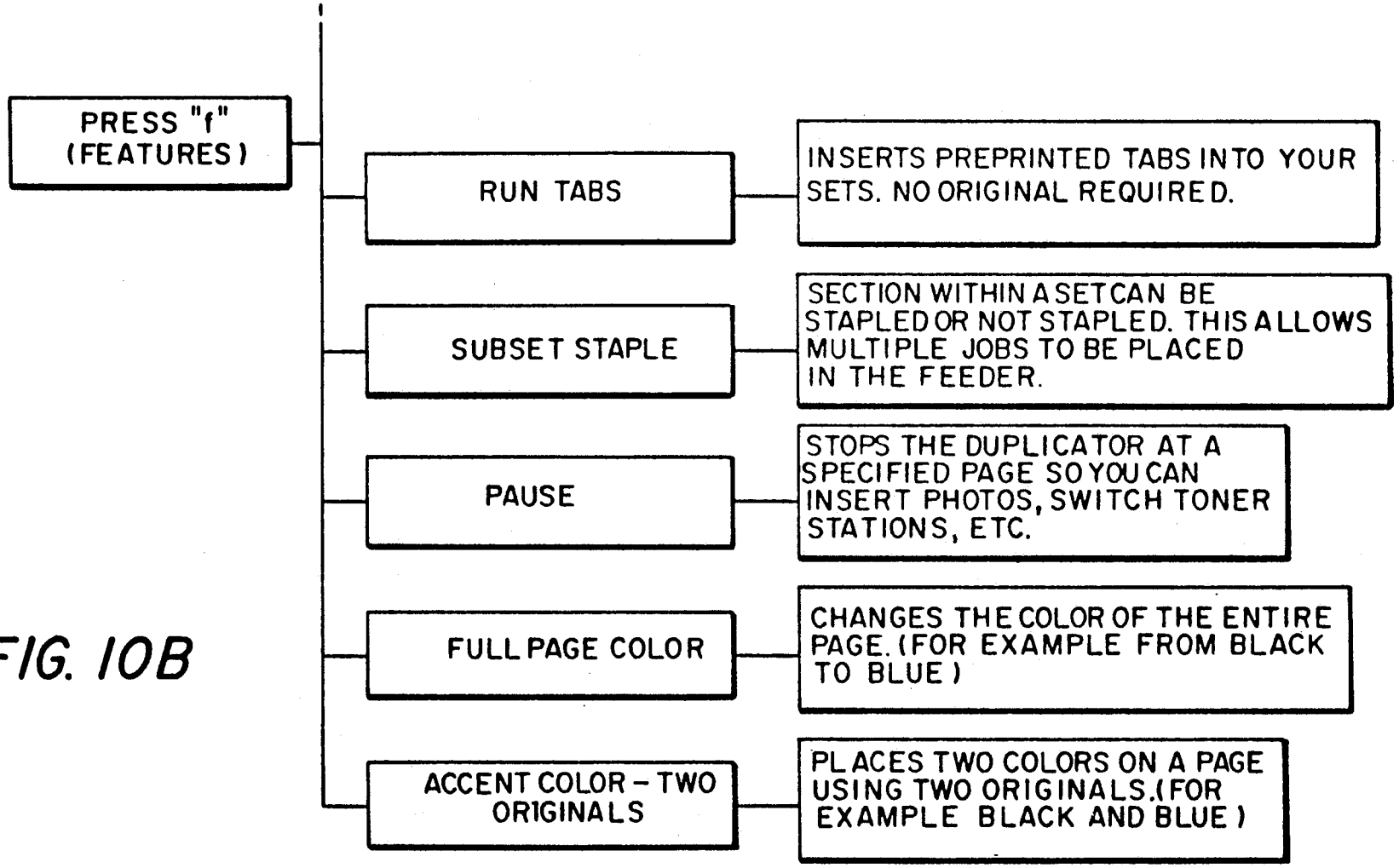

With reference now to FIG. 4, a special features-page level screen display is illustrated on the JSUD display. This screen is called up by selecting the page level designated buttons when the special features job level screen of FIG. 3 is displayed. As noted in the screen display of FIG. 4 the various options available for page level special features are shown. In FIG. 10 a description is provided of each of the special features-page level. It will be noted that copy improvement for example is also a page-level option. What this means is that a particular page may be reproduced differently from the other pages. As noted in the comments section of this display the particular page is identified by placing the multisheet document original in the recirculating feeder (or a document positioner which is a conventional alternate feeder) and press the start button to cycle document originals from say the recirculating feeder until the desired document original is circulated through the feeder and back up to the top of the stack of originals. During the circulation of the originals from the bottom of the stack to the top, the LCU counts the originals being circulated and when the desired document is at the top of the stack the count of the LCU is stored in memory to identify this document.

With reference to FIGS. 9(*a–i*), description is provided of the steps for selecting page-level copy improvement for a particular page and for making the appropriate inputs to set up the apparatus to copy that document page differently from the others. In comparing these figures with those of FIGS. 8(*a–h*), it will be noted that there are many constants or similarities of operator interaction with the display screen to promote user friendliness. For example, the "scroll", "select", "done/exit" buttons remain unchanged in function and position. The use of a rectangle about the option under consideration for selection, FIG. 9(*b*). The use of the hollow box to indicate to the operator that a further screen is required to complete the entry, FIG. 9(*d*). Another commonality, is the done/exit to get to the next screen FIG. 9(*e*). The similarity of the button functions at the secondary level, compare FIG. 9(*f*) with that for the corresponding job level set-up shown in FIG. 8(*e*). The use of the solidly colored box to indicate that "copy improvement" has been selected at the page level, FIG. 9(*h*) . At this point, either further selections of options may be made at the page level or the B4 button pressed to activate an "arrange stack" signal to the LCU which causes the LCU to commence automatic feeding of the document originals through the feeder to return them to their original order. At this point, a copy operation may be begun by pressing the start button and an indicated number of copy sets will be made with each copy set having a particular contrast and density made in accordance with the setup instructions.

Figure 11B:
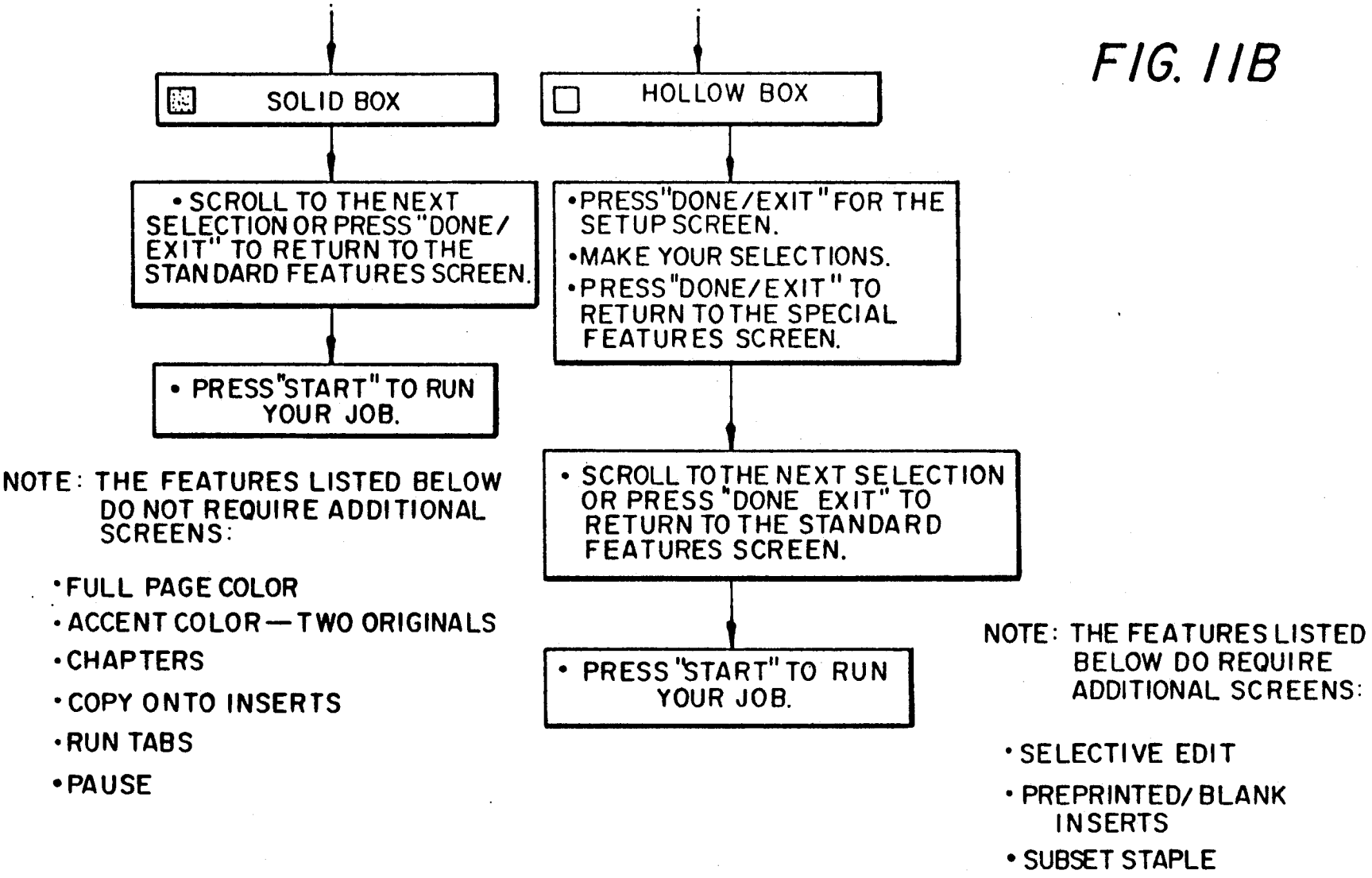
FIG. 11 is a flowchart explaining the use of the displays for selecting various features on a page level basis.

With reference now to FIG. 11 it may be seen that the flowchart for selection of features at the page level is quite similar to that at the job level, see FIG. 7.

Figure 12:
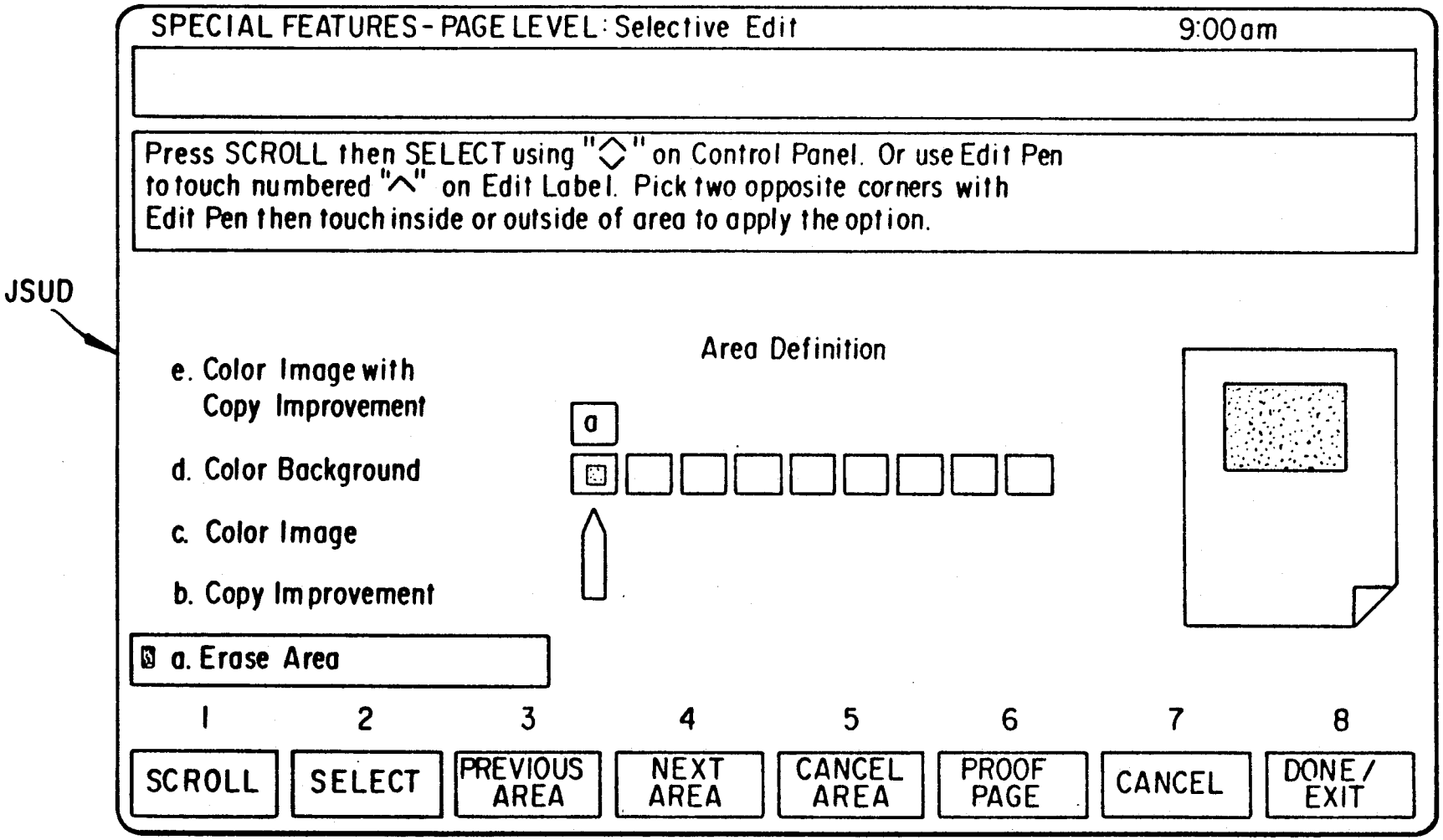
FIG. 12 is a view of a display screen with the display on the screen providing options with a page level option for selective edit.
Figure 13:
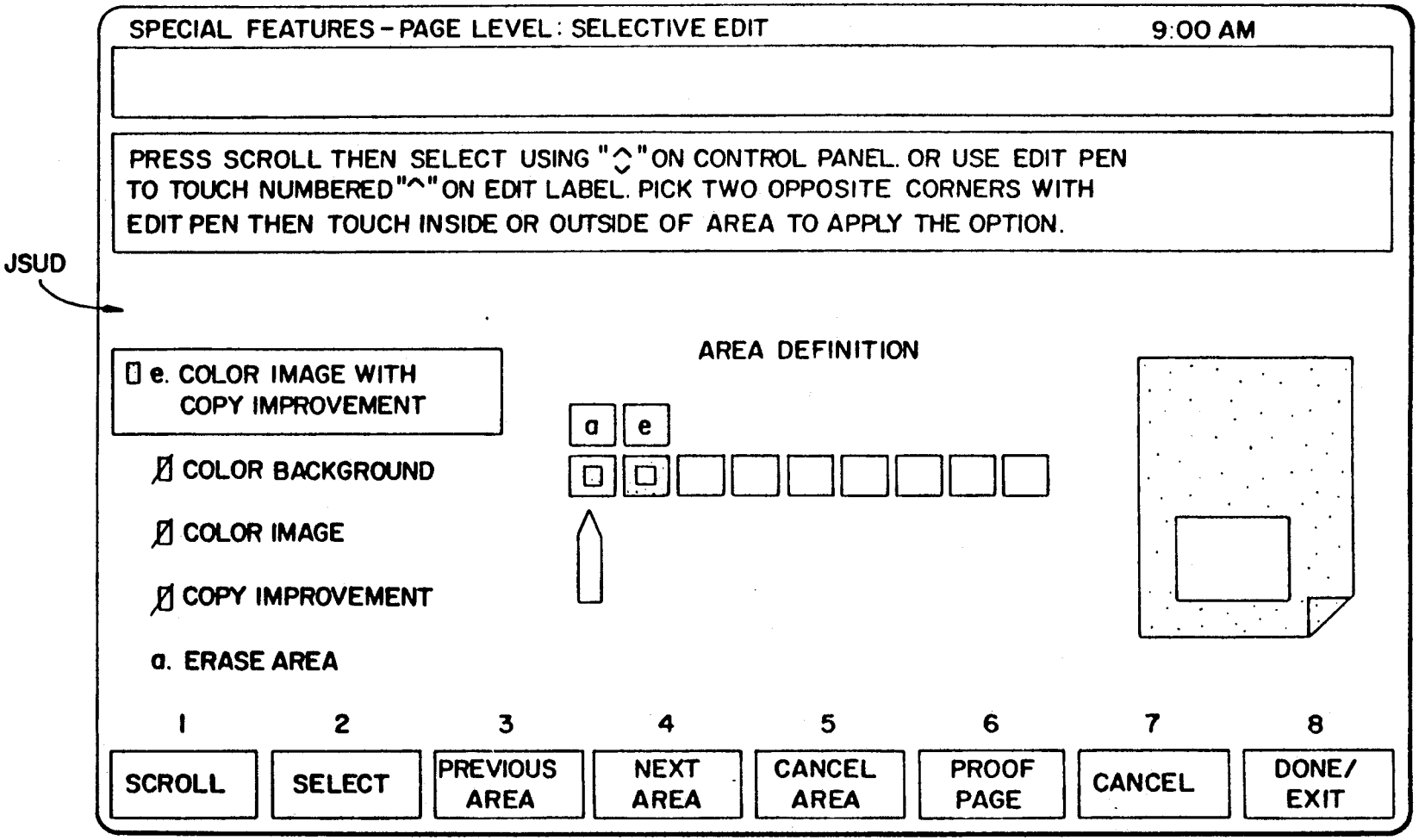
FIG. 13 is a view of the display screen with the screen indicating selection of an option within a page level option and illustrating certain options which may not be selected in view of selection of a different option.

With reference now to FIGS. 12 and 13 another special feature-page level screen is shown and relates to selective edit. In the selective edit mode a digitizing tablet associated with the apparatus is used to designate an area on a document sheet for special treatment. Description of such a tablet is fully provided in the incorporated by reference U.S. Pat. No. 4,740,818. In the instant apparatus the digitizer 52 is not part of the exposure platen and may be of any of known types of digitizers which are adapted to generate signals identifying the locations of selected points on a document using say a wand 54 and calculating electronics which provide digitization signals to the LCU which controls the operation of an LED printhead to say erase selected areas designated by use of the digitizer in accordance with well known techniques.

Figure 14A:
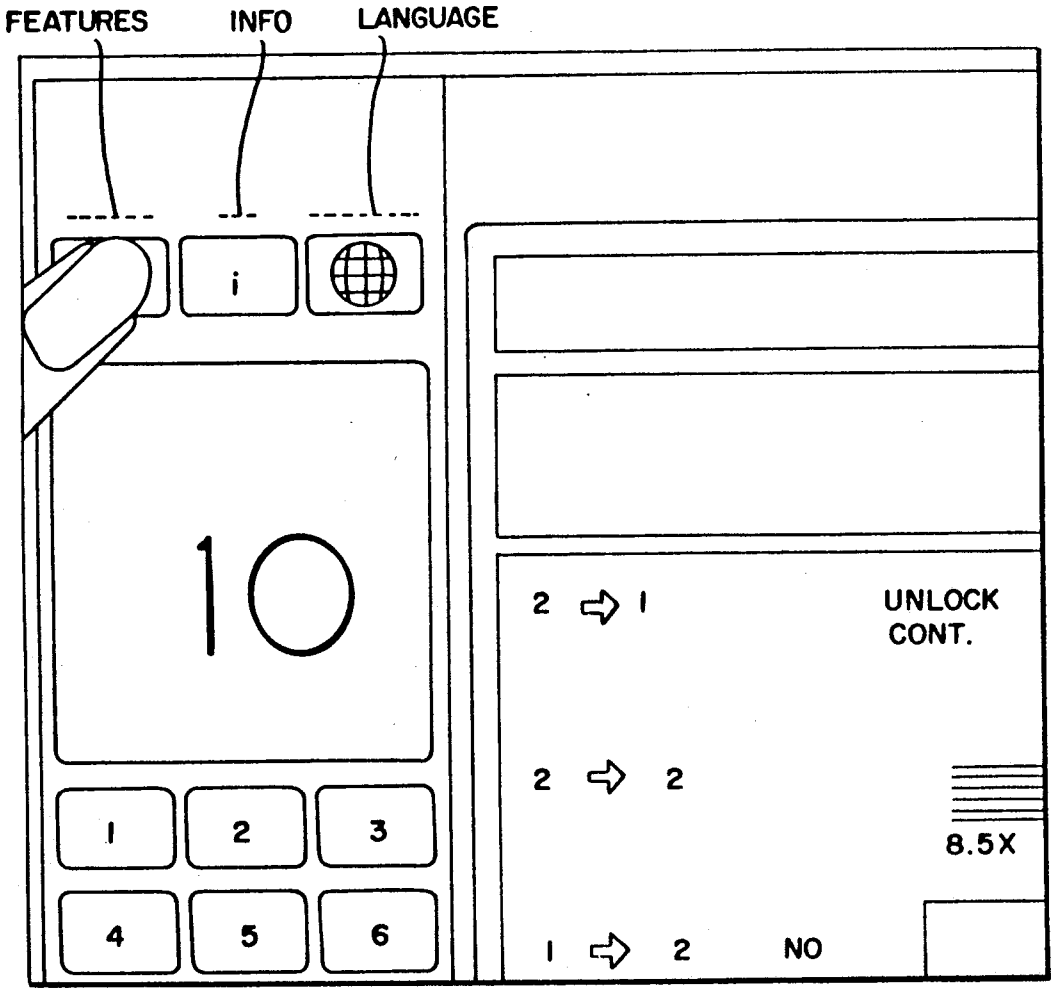
FIGS. 14 (*a–p*) describe and illustrate a series of steps for selecting a specific page level feature.
Figure 14B:
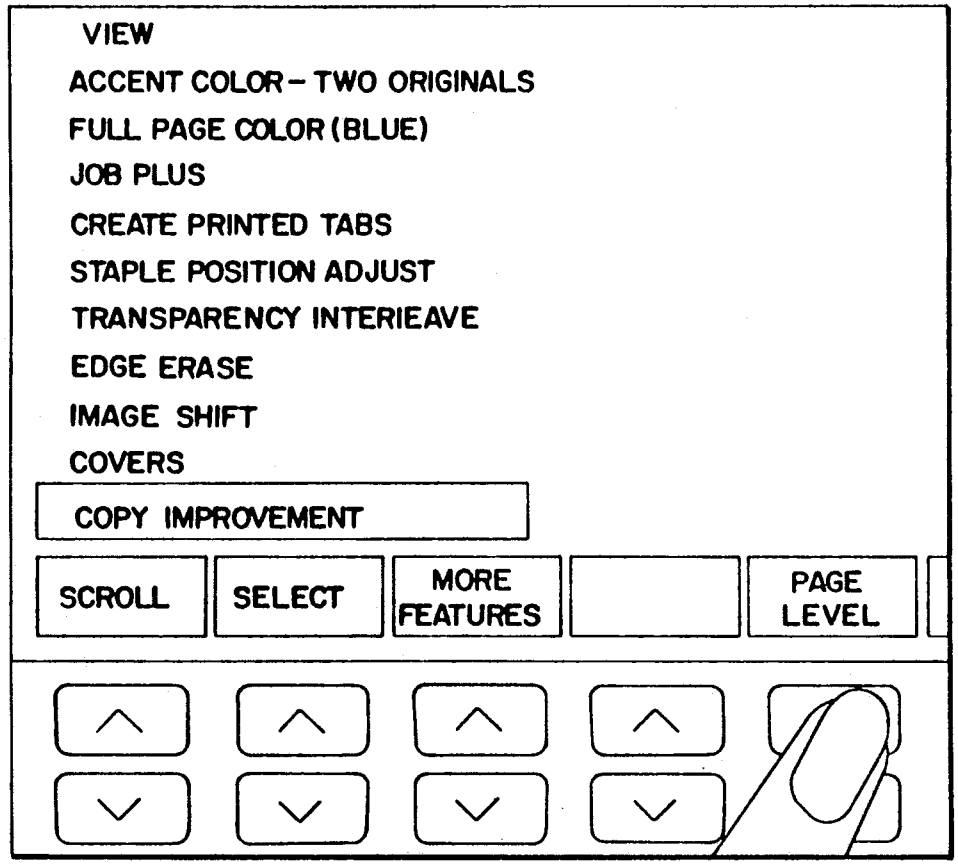
Figure 14C:
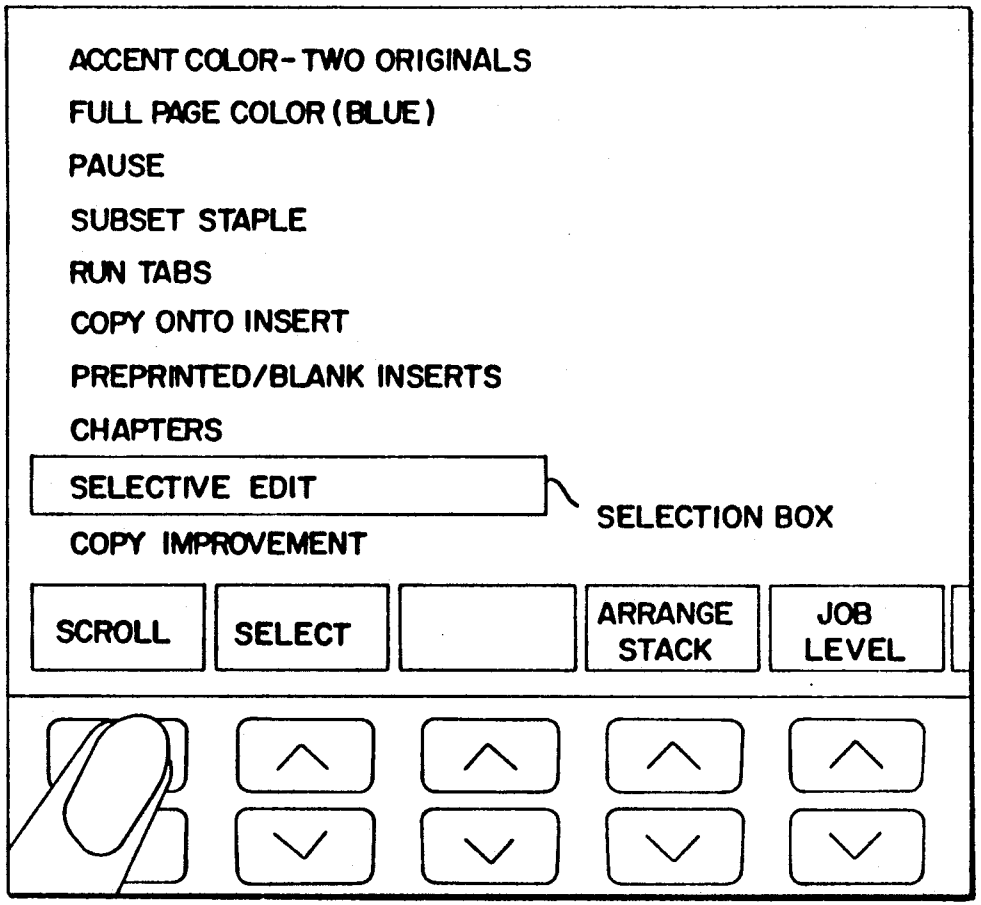
Figure 14D:
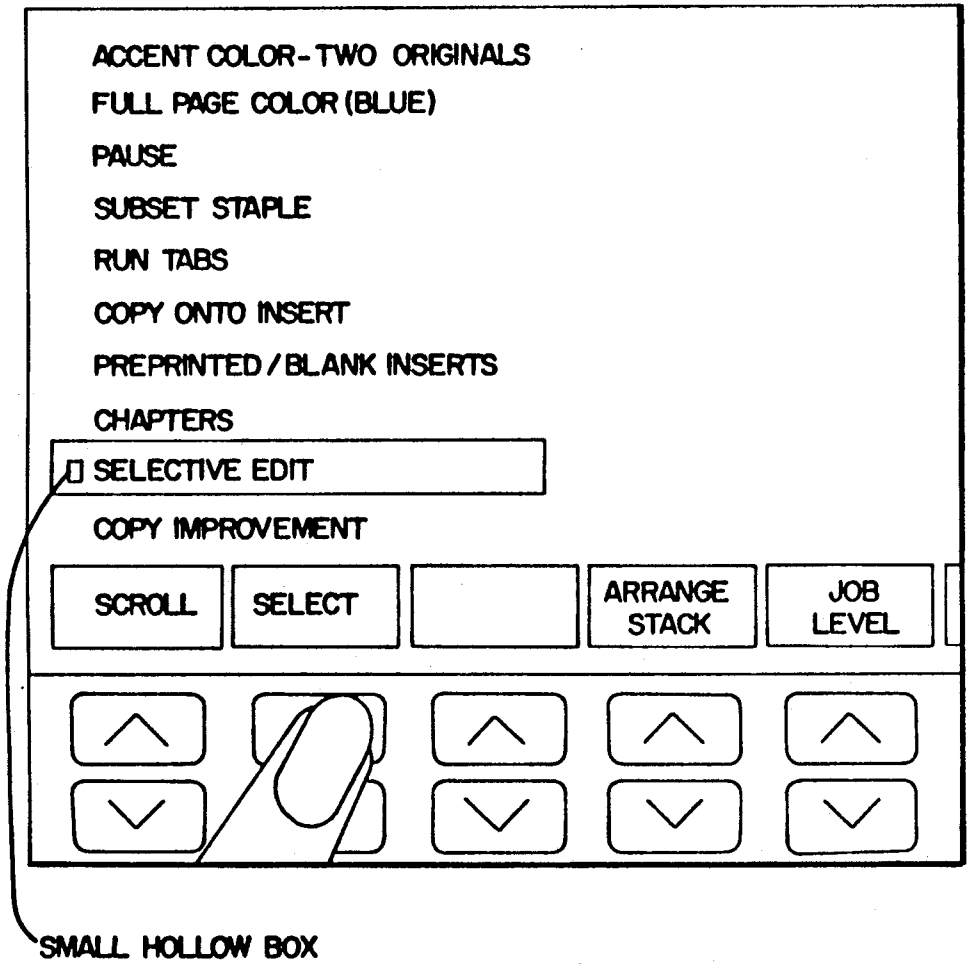
Figure 14E:
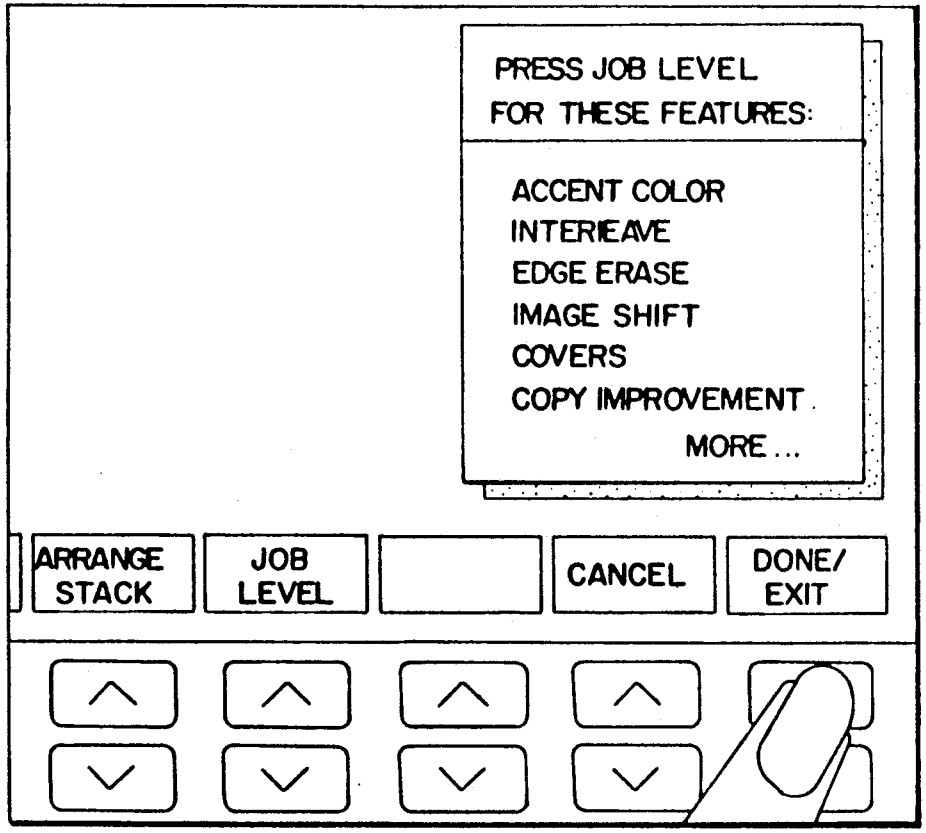
Figure 14F:
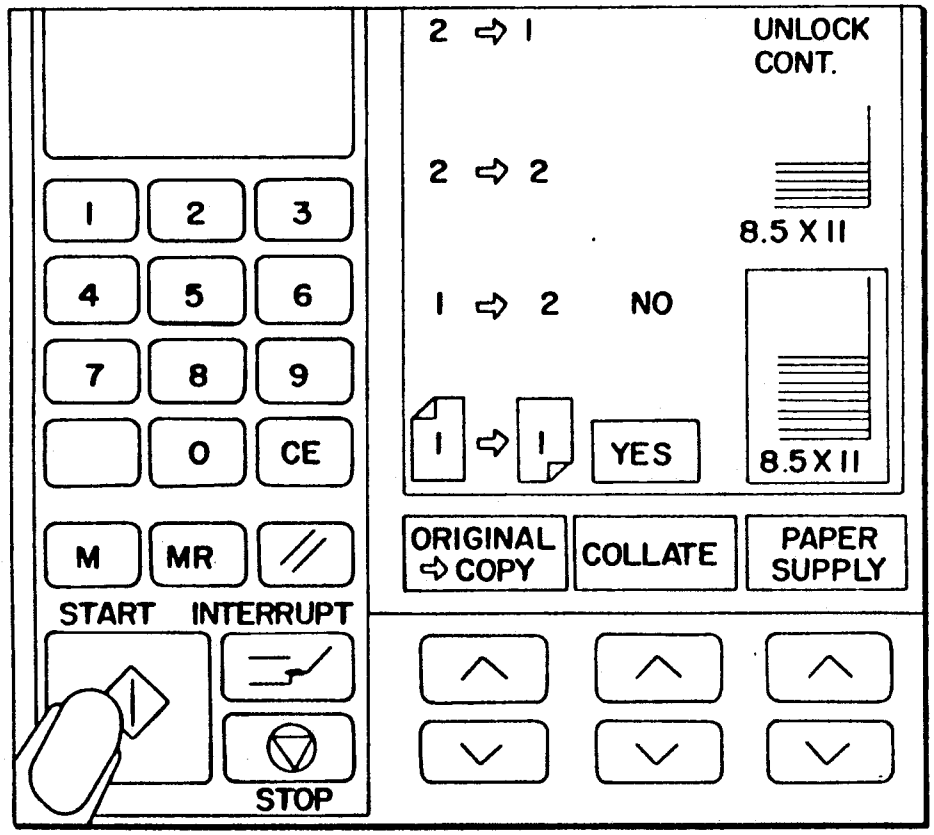
Figure 14G:
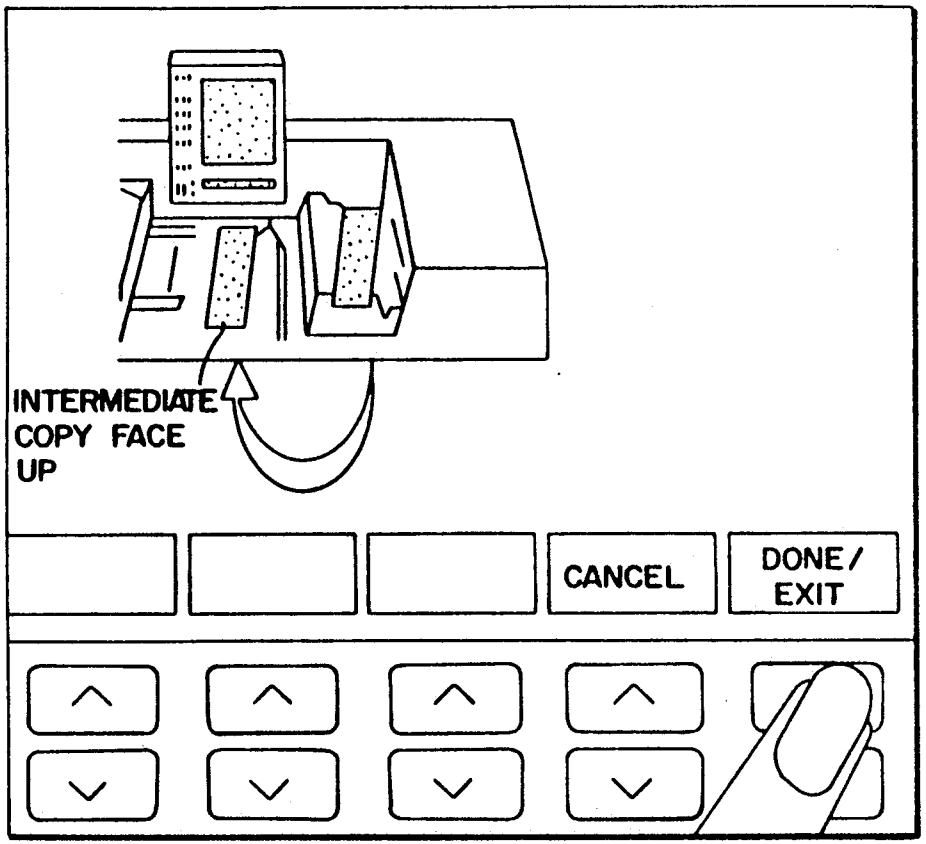
Figure 14H:
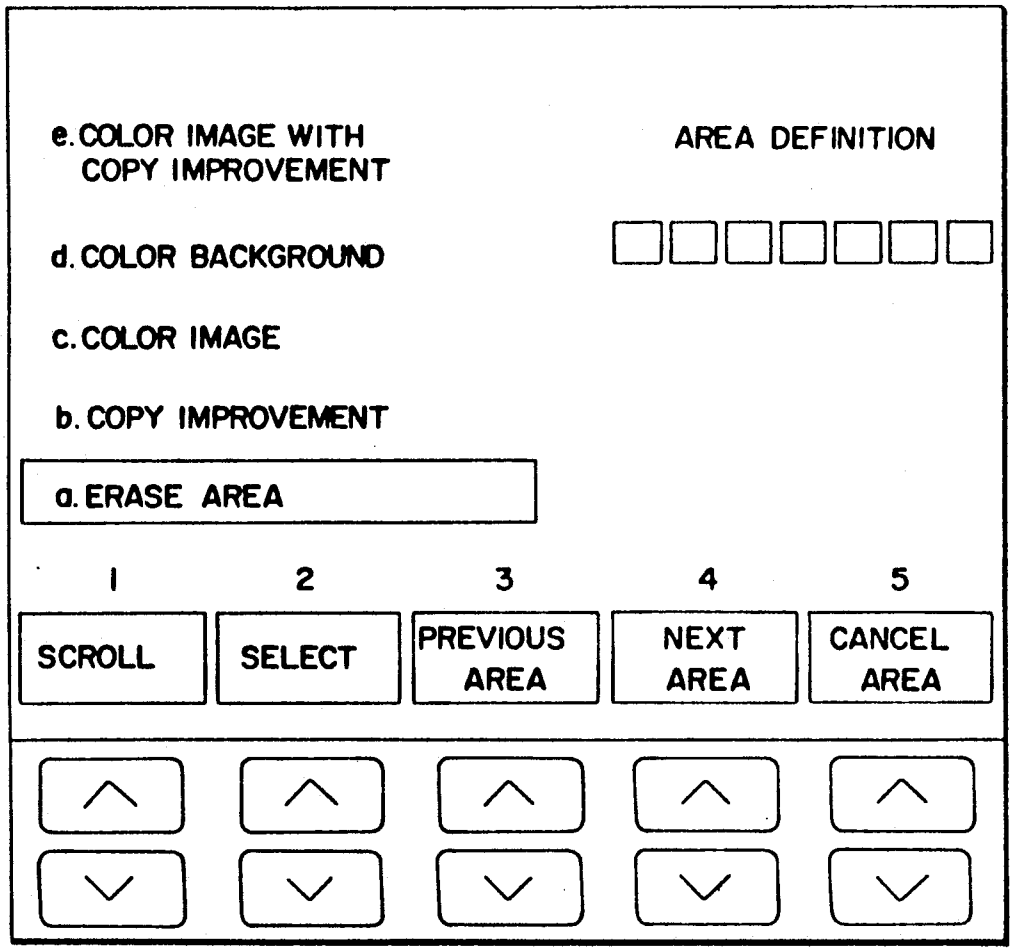
Figure 14J:
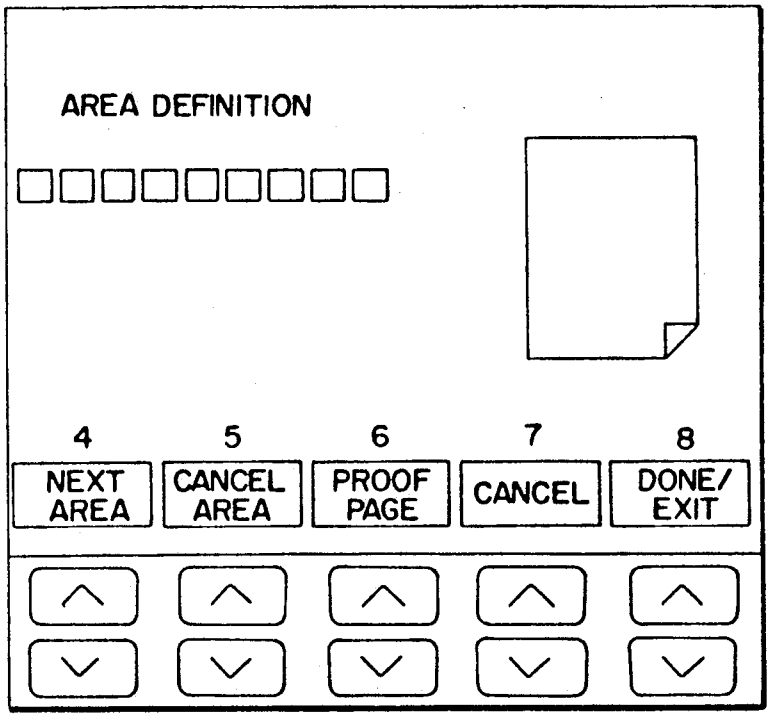
Figure 14I:
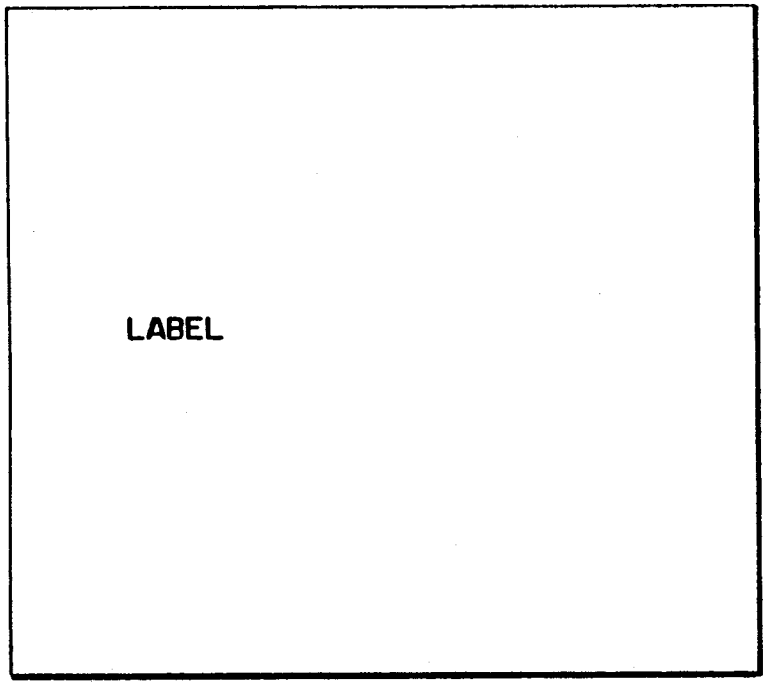
Figure 14K:
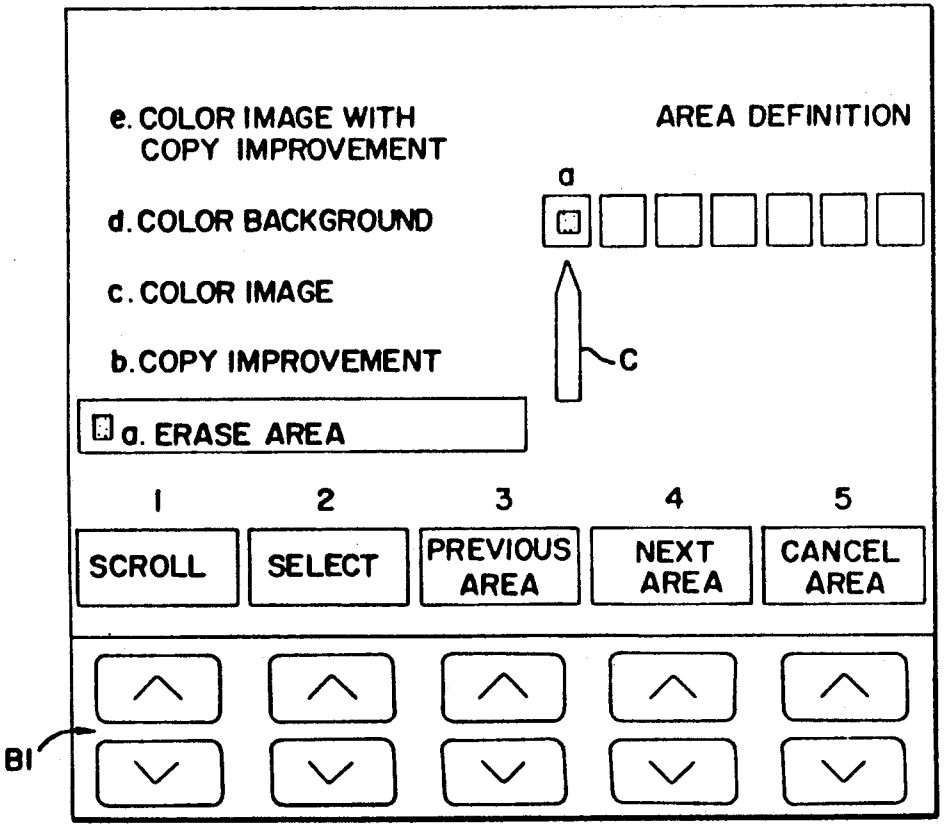
Figure 14:
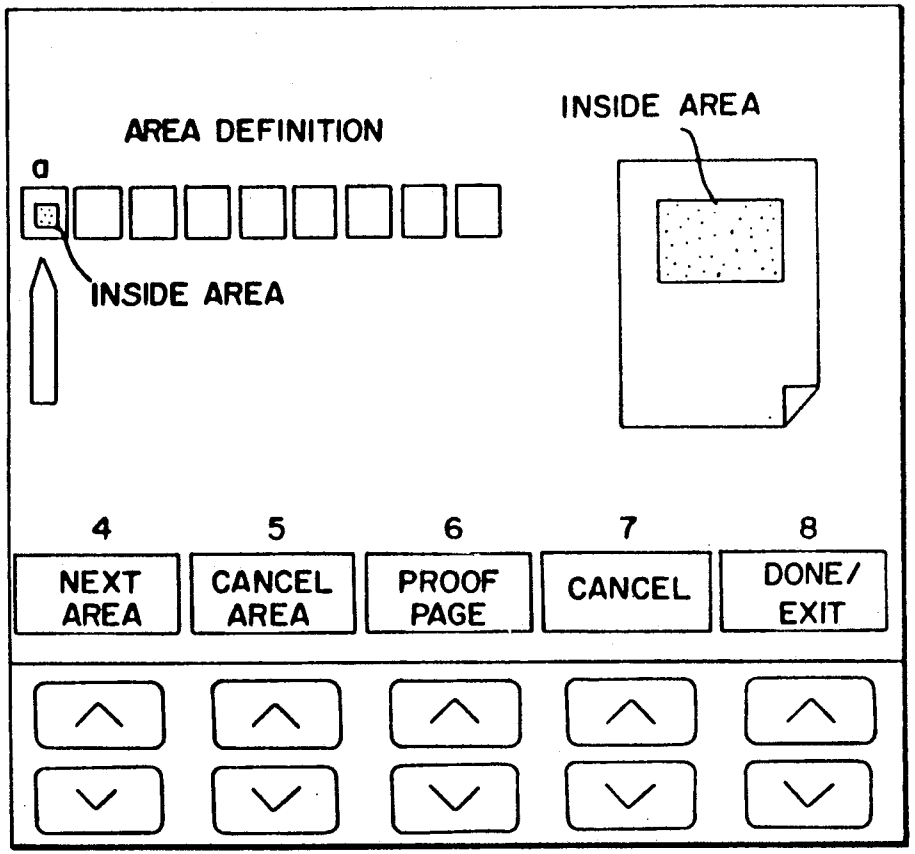
Figure 14M:
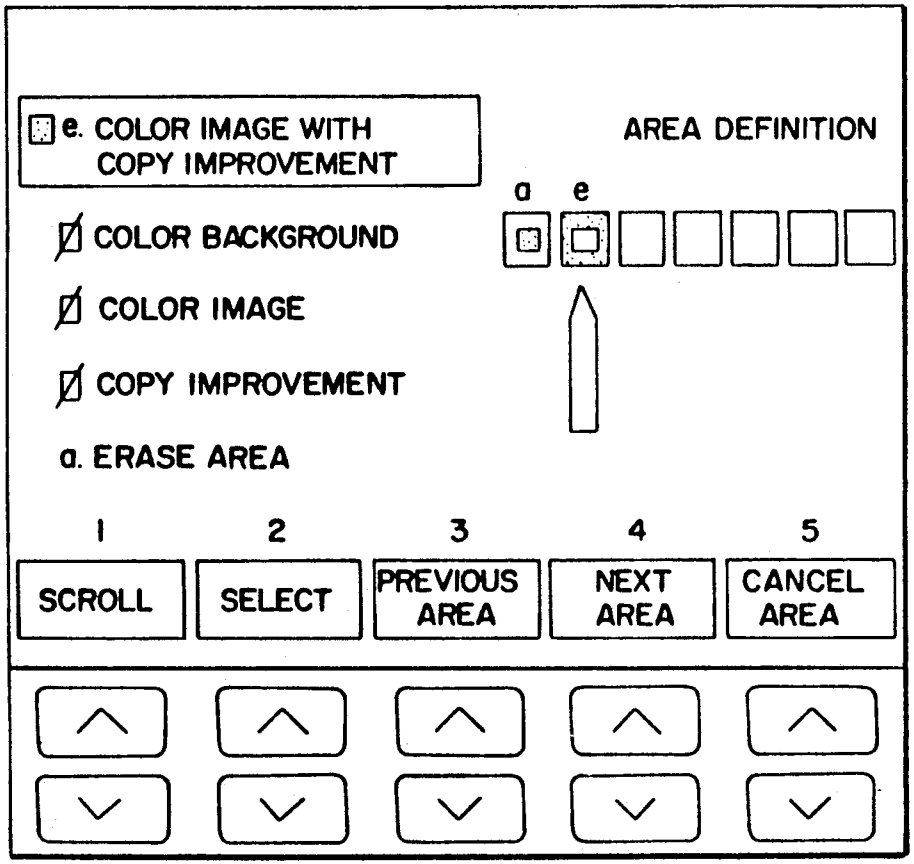
Figure 14N:
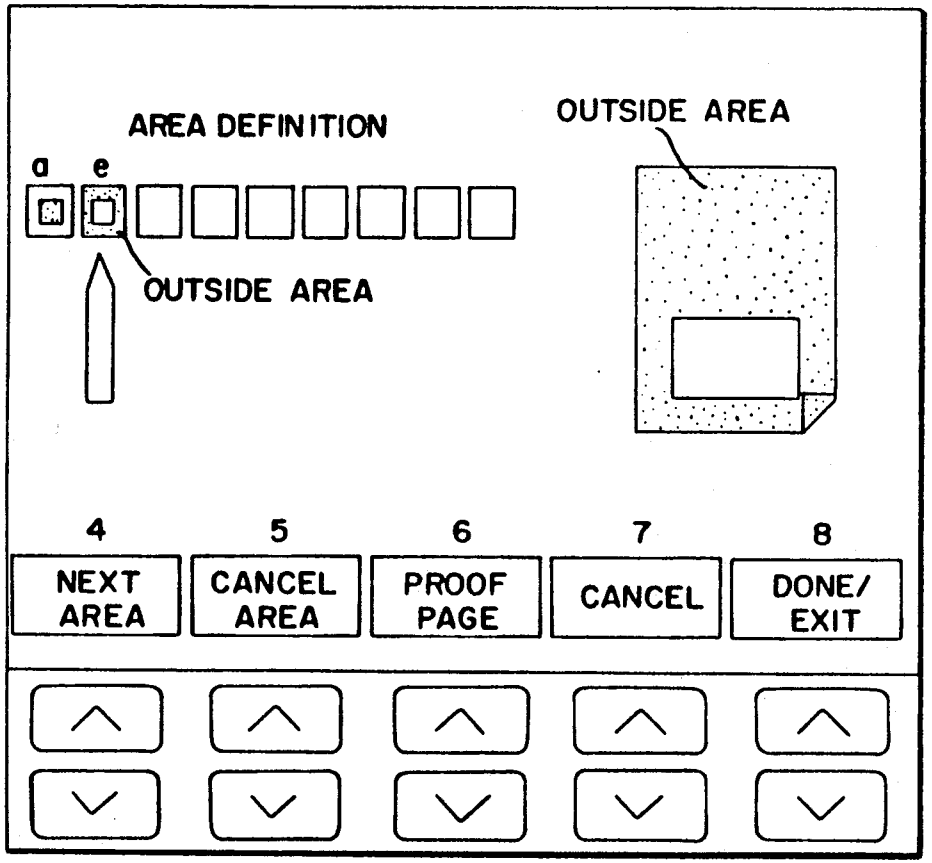
Figure 14O:
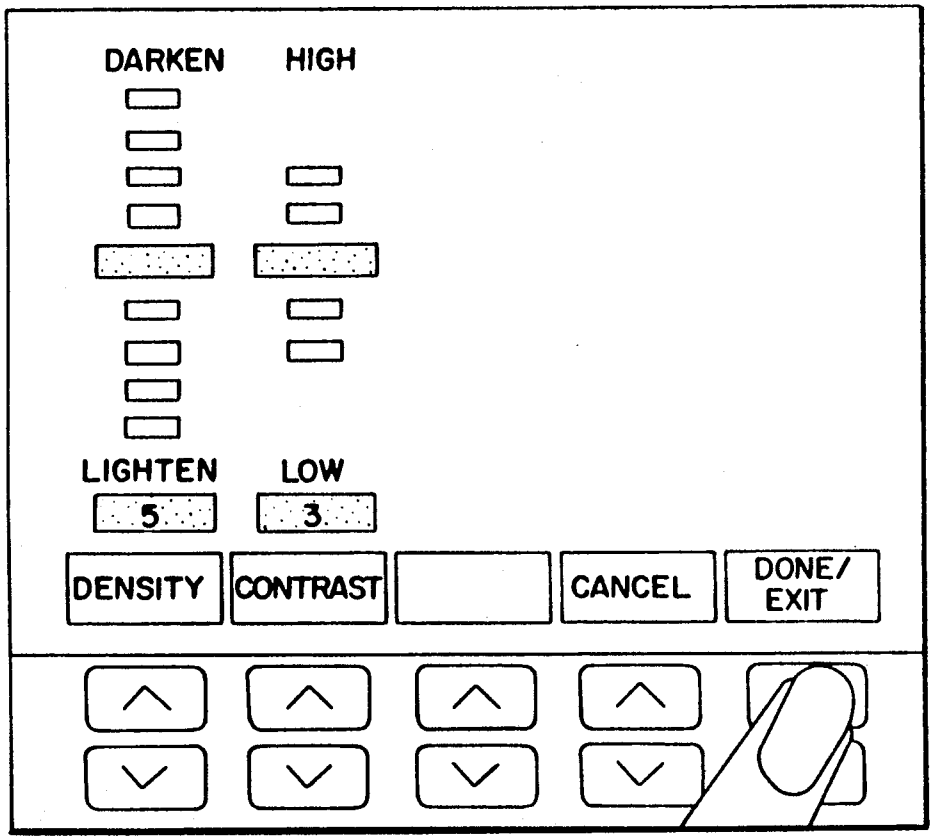
Figure 14P:
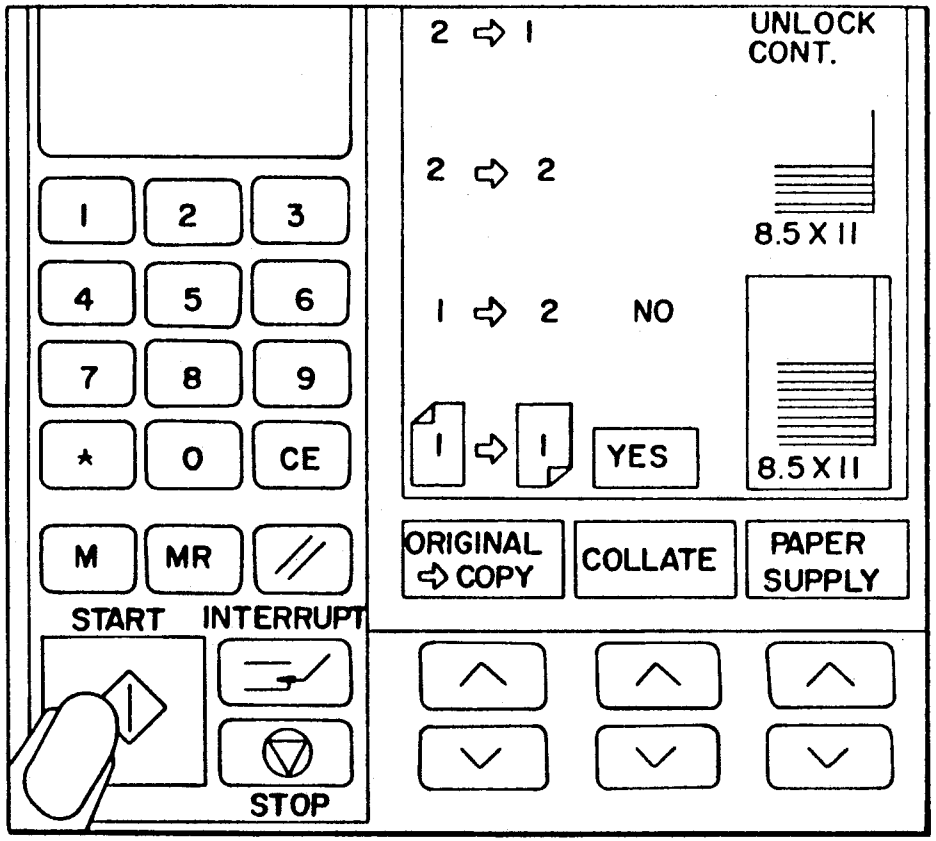

As may be seen in FIGS. 12, 13 and 14, the JSUD employs the "scroll", "select", "done/exit" function at similar locations and are activated by button groups B1, B2 and B8 respectively. Using button B1 the operator may scroll through the listed special features and select say "erase area". Note that selective edit is a page level feature and is selectable when the special features-page level main display is called up see steps shown in FIGS. 14(*a–d*). Note also the continuity of the use of the rectangle about a selectable item under consideration FIG. 14(*c*), the use of the hollow box to indicate selection of this option FIG. 14(*d*) and which indicates the need to exit to another screen for further inputs. At this stage, the instructions in the JSUD advise the operator to press the "start" button to make an intermediate copy of the document sheet whose reproduction(s) are to be edited versions of the original. Prior to making this intermediate copy the particular original page has been circulated to the top of the stack which is consistent with previous described operations at the page level. The position of the original in the stack is stored in the LCU's memory. After an intermediate copy is made this intermediate copy is removed from the top exit tray and placed face-up on the digitizing tablet as illustrated and instructed by the display on the JSUD FIG. 14(*g*). In the screen display illustrated in FIG. 14(*h*) various editing options are indicated and the "scroll" button set B1 may be used to indicate one as being sought for consideration by use of a rectangle around the word descriptor. The operator is then instructed as indicated in FIG. 14(*j*) to digitize an area of the original by identifying two opposite corners of the rectangular area. As shown in FIG. 14(*k*) and FIG. 12 the function "erase area" has been selected and no further screens are required to be exited to as indicated by the solidly colored box. The JSUD display at this point illustrates the area selected on a display of a sheet and, with the possibility of up to 9 possible areas for selective editing, 9 area definition boxes are illustrated and indication can be made in each of the operation as being within the selected area or outside thereof. A cursor display C points to the area being considered during the selection of a particular editing function. In addition, a letter descriptor of each function appears over each completed area definition box. It will be noted in FIG. 14(*m*) that a color image with copy improvement has been selected for the second area. As the second area is being considered the rectangular box and solidly colored box associated with "erase area" as shown in FIG. 14(*k*) are eliminated in FIG. 14(*m*) since the first area is no longer under consideration. FIG. 14(*m*) also illustrates an additional symbol of a hollow box with a slash through it. This signal implies that for the area under consideration these other items are not selectable as these other selections are redundant or otherwise not selectable with that selected for that area.

After the desired selective edit areas are defined and their respective editing functions also defined the signals representing these selections are stored by the LCU and reproductions made of the multisheet document with selective editing of the particular page designated for editing. In reproducing a document with one area in one color and another area in another color the original document sheet may be flash exposed onto two image frames of the photoconductor. Prior to each exposure the LED bar is selectively activated by the LCU 31 to erase areas of each image frame so that a portion of the latent image of the document original remains on each and that portion is to be reproduced on a respective color. The latent images on the respective image frames are developed using respective development stations 19, 19*a*. The developed image in one color is transferred to the receiver or copy sheet and then fused and returned to the duplex tray. The copy sheet is then advanced in timed relationship with the second image frame and removed from the duplex tray to transfer the second colored image. Reproduction of the remainder of the document original is in accordance with the programmed instructions.

There has thus been described a job set-up display that reduces the need for complex display panels and appears user friendly to those approaching the apparatus for an average reproduction operation. For a more complex operation, job set-up is provided in layered fashion, i.e., standard features display to job level display to page level display in a relatively consistent manner and with consistent functions thereby facilitating complex job programming.

While the invention has been described with reference to electrophotographic copier/duplicators, the invention is also applicable to printers and other types of reprographic apparatus for producing copy.

The invention has been described in detail with particular reference to a preferred embodiment thereof, but it will be understood that variations and modifications can be effected within the spirit and scope of the invention as described hereinabove and as defined in the appended claims.

What is claimed is:

1. A reproduction apparatus for producing copy, said apparatus comprising:

an operator control panel, said panel including means including a display screen for indicating on said screen certain standard selectable features for a copying operation including copy format, paper supply source, copy quality, magnification and exit location with plural displayed options for each feature, and first means for altering the display on the screen to indicate a displayed selected option for each and generating a first set of signals representing selected options of the standard features;

means for altering the display on said screen to display various operator selectable special job level features for a copying operation available on a job level basis, and second means for altering the display to indicate displayed special selected job level features for reproducing a job comprising a multisheet document with said special job level features and generating a second set of signals representing selected special job level features;

means for altering the display on said screen to display various operator selectable special page level features for a copying operation specific to reproducing a selected page of the multisheet document job, and third means for altering the display to indicate displayed selected special page level features for reproducing said page with said special page level features and generating a third set of signals representing selection of special page level features; and means responsive to said first, second and third sets of signals for producing copy comprised of a multisheet document, said multisheet document being produced in accordance with the options selected from the standard features, the job level features and having at least one page produced in accordance with the selected page level features.

2. The apparatus of claim 1 and wherein the panel includes a first key entry means for scrolling respective indicators to identify one of the job level features and page level features being considered for selection; and second key entry means for selecting the identified job level feature and page level feature.

3. The apparatus of claim 2 and including means for generating indicators on said display representing a completed selection of a feature and an uncompleted selection of a feature indicating further additional options are available relative to said feature.

4. The apparatus of claim 3 and including means for generating on said display an indicator representing a feature that may not be selected in response to selection of a selected feature.

5. The apparatus of claim 4 and wherein the indicators comprise a solidly colored pictorial figure adjacent to a word description representing the feature and representing a completed selection of that feature, a hollow pictorial figure adjacent to a word description representing an incomplete selection of a feature and a hollow pictorial figure with a diagonal slash line through said figure adjacent to a word description of a feature that may not be selected.

6. A reproduction apparatus for producing copy, said apparatus comprising:

an operator control panel, said panel including means including a display screen for indicating on said screen certain selectable first features for a copying operation, and first means for altering the display on the screen to indicate a displayed selected option for each feature and generating a first set of signals representing selected options of the first features;

means for altering the display on said screen to display various additional operator selectable special job level features for a copying operation available on a job level basis, and second means for altering the display to indicate displayed special selected job level features for reproducing a job comprising a multisheet document with said special job level features and generating a second set of signals representing selected special job level features;

means for altering the display on said screen to display various operator selectable special page level features for a copying operation specific to reproducing a selected page of the multisheet document job, and third means for altering the display to indicate displayed selected special page level features for reproducing said page with said special page level features and generating a third set of signals representing selection of special page level features; and means responsive to said first, second and third sets of signals for producing copy comprised of a multisheet document, said multisheet document being produced in accordance with the options selected from the first features, the job level features and having at least one page produced in accordance with the selected page level features.

7. The apparatus of claim 6 and wherein the panel includes a first key entry means for scrolling respective indicators to identify one of the job level features and page level features being considered for selection; and second key entry means for selecting the identified job level feature and page level feature.

8. The apparatus of claim 7 and including means for generating indicators on said display representing a completed selection of a feature and an uncompleted selection of a feature indicating further additional options are available relative to said feature.

9. The apparatus of claim 8 and including means for generating on said display an indicator representing a feature that may not be selected in response to selection of a selected feature.

10. The apparatus of claim 9 and wherein the indicators comprise a solidly colored pictorial figure adjacent to a word description representing the feature and representing a completed selection of that feature, a hollow pictorial figure adjacent to a word description representing an incomplete selection of a feature and a hollow pictorial figure with a diagonal slash line through said figure adjacent to a word description of a feature that may not be selected.

11. A reproduction method for producing copy, said method comprising:

generating on a display screen indicia indicating on said screen certain selectable first features for a copying operation;

in response to operator input altering the display on the screen to indicate a displayed selected option for each feature and generating a first set of signals representing selected options of the features;

altering the display on said screen to display various additional operator selectable special job level features for a copying operation available on a job level basis;

in response to operator input, altering the display to indicate displayed special selected job level features for reproducing a job comprising a multisheet document with said special job level features and generating a second set of signals representing selected special job level features;

altering the display on said screen to display various operator selectable special page level features for a copying operation specific to reproducing a selected page of the multisheet document job;

in response to operator input, altering the display to indicate displayed selected special page level features for reproducing said page with said special page level features and generating a third set of signals representing selection of special page level features; and in response to said first, second and third sets of signals producing copy comprised of a multisheet document, said multisheet document being produced in accordance with the options selected from the first features, the job level features and having at least one page produced in accordance with the selected page level features.

12. The method of claim 11 and wherein the operator actuates a first key for scrolling respective indicators to identify one of the job level features and page level features being considered for selection; and actuates a second key for selecting the identified job level feature and page level feature.

13. The method of claim 12 and including generating indicators on said display representing a completed selection of a feature and an uncompleted selection of a feature indicating further additional options are available relative to said feature.

14. The method of claim 13 and including a generating on said display an indicator representing a feature that may not be selected in response to selection of a selected feature.

15. The method of claim 14 and wherein the indicators comprise a solidly colored pictorial figure adjacent to a word description representing the feature and representing a completed selection of that feature, a hollow pictorial figure adjacent to a word description representing an incomplete selection of a feature and a hollow pictorial figure with a diagonal slash line through said figure adjacent to a word description of a feature that may not be selected.

16. A reproduction apparatus for producing copy, said apparatus comprising:

an operator control panel, said panel including means including a display screen for indicating on said screen certain selectable first features for a copying operation;

first means for altering the display on the screen to indicate selection of a displayed selected feature and generating a first signal representing selection of the selected features; and means for generating indicators on said display representing a completed selection of the selected feature or an uncompleted selection of the selected feature indicating further additional options are available relative to said feature; and means for generating on said display an indicator representing a feature that may not be selected in response to selection of the selected feature.

17. The apparatus of claim 16 and wherein the indicators comprise a solidly colored pictorial figure adjacent to a word description representing the selected feature and representing a completed selection of that feature, a hollow pictorial figure adjacent to a word description representing an incomplete selection of a selected feature and a hollow pictorial figure with a diagonal slash line through said figure adjacent to a word description of a feature that may not be selected.

18. A reproduction apparatus for producing copy, said apparatus comprising:

an operator control panel, said panel including means including a display screen for indicating on said screen certain first features for a copying operation; and first means for generating a first set of signals representing selection of the first features for a copyying operation;

means for altering the display on said screen to display various additional operator selectable special job level features for a copying operation available on a job level basis, and second means for altering the display to indicate displayed special selected job level features for reproducing a job comprising a multisheet document with said special job level features and generating as second set of signals representing selected special job level features;

means for altering the display on said screen to display various operator selectable special page level features for a copying operation specific to reproducing a selected page of the multisheet document job, and third means for altering the display to indicate displayed selected special page level features for reproducing said page with said special page level features and generating a third set of signals representing selection of special page level features; and means responsive to said first, second and third set of signals for producing copy comprised of a multisheet document, said multisheet document being produced in accordance with the selected first features, the job level features and having at least one page produced in accordance with the selected page level features.

19. The apparatus of claim 18 and wherein the panel includes a first key entry means for scrolling respective indicators to identify one of the job level features and page level features being considered for selection; and second key entry means for selecting the identified job level feature and page level feature.

20. The apparatus of claim 19 and including means for generating indicators on said display representing a completed selection of a feature and an uncompleted selection of a feature indicating further additional options are available relative to said feature.

21. The apparatus of claim 20 and including means for generating on said display an indicator representing a feature that may not be selected in response to selection of a selected feature.

22. The apparatus of claim 21 and wherein the indicators comprise a solidly colored pictorial figure adjacent to a word description representing the feature and representing a completed selection of that feature, a hollow pictorial figure adjacent to a word description representing an incompleted selection of a feature and a hollow pictorial figure with a diagonal slash line through said figure adjacent to a word description of a feature that may not be selected.

23. A reproduction method for producing copy, said method comprising:

generating on a display screen indicia indicating on said screen certain first features for a copying operation;

generating a first set of signals representing selection of the first features;

altering the display on said screen to display various additional operator selectable special job level features for a copying operation available on a job level basis;

in response to operator input, altering the display to indicate displayed special selected job level features for reproducing a job comprising a multisheet document with said special job level features and generating a second set of signals representing selected special job level features;

altering the display on said screen to display various operator selectable special page level features for a copying operation specific to reproducing a selected page of the multisheet document job;

in response to operator input, altering the display to indicate displayed selected special page level features for reproducing said page with said special page level features for reproducing said page with said special page level features and generating a third set of signals representing selection of special page level features; and in response to said first, second and third sets of signals producing copy comprised of a multisheet document, said multisheet document being produced in accordance with the options selected from the first features, the job level features and having at least one page produced in accordance with the selected page level features.

24. The method of claim 23 and wherein the operator actuates a first key for scrolling respective indicators to identify one of the job level features and page level features being considered for selection; and actuates a second key for selecting the identified job level feature and page level feature.

25. The method of claim 24 and including generating indicators on said display representing a completed selection of a feature and an uncompleted selection of a feature indicating further additional options are available relative to said feature.

26. The method of claim 25 and including generating on said display an indicator representing a feature that may not be selected in response to selection of a selected feature.

27. The method of claim 26 and wherein the indicators comprise a solidly colored pictorial figure adjacent to a word description representing the feature and representing a completed selection of that feature, a hollow pictorial figure adjacent to a word description representing an incompleted selection of a feature and a hollow pictorial figure with a diagonal slash line through said figure adjacent to a word description of a feature that may not be selected.

* * * * *